US005645706A

United States Patent [19]

Matsuda

[11] Patent Number: 5,645,706

[45] Date of Patent: Jul. 8, 1997

[54] PHOSPHATE CHEMICAL TREATMENT METHOD

[75] Inventor: Shigeki Matsuda, Okazaki, Japan

[73] Assignee: Nippondenso Co., Ltd., Kariya, Japan

[21] Appl. No.: 551,695

[22] Filed: Nov. 1, 1995

Related U.S. Application Data

[63] Continuation of Ser. No. 175,416, filed as PCT/JP93/00593 Apr. 30, 1993, published as WO93/22481 Nov. 11, 1993, abandoned.

[30] Foreign Application Priority Data

Apr. 30, 1992 [JP] Japan ..... 4-137833

[51] Int. Cl.[6] ..... C25D 9/02

[52] U.S. Cl. ..... 205/82; 205/98; 205/318; 148/253

[58] Field of Search ..... 205/98, 101, 171, 205/318, 320, 82; 148/253

[56] References Cited

U.S. PATENT DOCUMENTS

| | | | |
|---|---|---|---|
| 4,565,585 | 1/1986 | Matsuda | 148/253 |
| 4,622,078 | 11/1986 | Opitz et al. | 148/6.15 |
| 4,874,480 | 10/1989 | Sonoda | 205/212 |
| 5,039,361 | 8/1991 | Hauffe | 148/253 |
| 5,254,321 | 10/1993 | Jackson | 423/55 |
| 5,401,381 | 3/1995 | Seidel | 205/177 |

FOREIGN PATENT DOCUMENTS

| | | |
|---|---|---|
| 1554824 | 1/1969 | France . |
| 55-41930 | 3/1980 | Japan . |
| 60-43491 | 3/1985 | Japan . |
| 60-46197 | 10/1985 | Japan . |
| 60-208479 | 10/1985 | Japan . |
| 60-238486 | 11/1985 | Japan . |
| 61-26783 | 2/1986 | Japan . |
| 61-96074 | 5/1986 | Japan . |
| 63-270478 | 11/1988 | Japan . |
| 468481 | 3/1989 | Japan . |
| 1116382 | 5/1989 | Japan . |
| 2149677 | 6/1990 | Japan . |
| 2153098 | 6/1990 | Japan . |
| 2190478 | 7/1990 | Japan . |
| 336296 | 2/1991 | Japan . |
| 4120294 | 4/1992 | Japan . |
| 4268096 | 9/1992 | Japan . |

OTHER PUBLICATIONS

Derwent Abstract of JP 53–92341 to Nippon Paint (Aug., 1978).

Zantout, et al: "Electrochemical Acceleration of Phosphating Processes", Transactions of the Institute of Metal Finishing, vol. 61, No. 3, 1983, pp. 88–92.

Gabe et al: "Anodic Acceleration of Phosphating Processes", Metal Finishing, vol. 83, No. 4, Apr. 1985, pp. 41–44.

*Primary Examiner*—John Niebling
*Assistant Examiner*—Brendan Mee
*Attorney, Agent, or Firm*—Cushman, Darby & Cushman IP Group of Pillsbury Madison & Sutro LLP

[57] ABSTRACT

The present invention is a method of forming a phosphate chemical treatment film which is efficient and allows a high-quality chemical film to be obtained, by which a substance to be treated is subjected to electrolytic treatment while removing the sludge, which consists of impurities other than the unavoidable impurities in the phosphate chemical treatment bath. According to this method, an adequate phosphate chemical treatment film may be formed onto any type of metal material, to provide phosphate chemical treatment films having thicknesses not obtainable by the prior art.

21 Claims, 31 Drawing Sheets

PHOSPHATE CHEMICAL TREATMENT METHOD

This is a continuation of application Ser. No. 08/175,416, filed as PCT/JP93/00593, Apr. 30, 1993, published as WO93/22481, Nov. 11, 1993, which was abandoned upon the filing hereof.

TECHNICAL FIELD

The present invention relates to a phosphate chemical treatment method by which a phosphate chemical film is formed on a metal surface, and more specifically, it relates to a treatment method by which a phosphate chemical film is formed on an electroconductive metal surface.

BACKGROUND ART

Methods of phosphate chemical treatment have been used in the past in various fields including surface preparation treatment before point-coating, pretreatment prior to cold working, and the like.

For example, in Japanese Unexamined Patent Publication (Kokai) No. 60-208479 there is disclosed a method for acid phosphate chemical treatment of iron, steel, zinc and/or aluminum surfaces.

Also, Japanese Unexamined Patent Publication (Kokai) No. 64-68481 discloses a method for the phosphate chemical treatment of steel and/or galvanized steel, or of metals consisting of aluminum and steel and/or galvanized steel.

Also, Japanese Unexamined Patent Publication (Kokai) No. 2-190478 discloses a chemical treatment bath containing $Fe^{+3}$ ion in a method of forming a phosphate film onto aluminum surfaces.

Also, in Japanese Unexamined Patent Publication (Kokai) No. 4-120294 there is disclosed a method of forming a phosphate chemical treatment coating as a surface preparation treatment before point-coating for stainless steel, in which the phosphate coating is formed by applying a PR (periodic reverse) pulse electric current to the stainless steel for electrolysis in a phosphate chemical treatment bath.

However, regarding methods for phosphate chemical treatment according to the prior art, there are many known methods of forming phosphate chemical coatings onto materials to be treated other than iron, as described in Japanese Unexamined Patent Publication (Kokai) No. 60-208479, Japanese Unexamined Patent Publication (Kokai) No. 64-68481 and Japanese Unexamined Patent Publication (Kokai) 2-190478, etc., but problems have been caused by the need to change the components of the phosphate chemical treatment bath and the conditions at the time of treatment, depending on the type of the material to be treated. In addition, the components and conditions for the phosphate chemical treatment bath are extremely critical, and not at all practical.

Furthermore, as in Japanese Unexamined Patent Publication (Kokai) No. 4-120294, the possibility has been known of forming phosphate chemical treatment coatings even onto materials to be treated other than steel, such as stainless steel, by subjecting the material to electrolysis in a phosphate chemical treatment bath, but such coatings are still limited to the formation of very thin films, such as surface preparation treatments before paint coating.

The present invention was accomplished with the object of overcoming the above mentioned problems, and its purpose is to provide a method for phosphate chemical treatment which makes it possible to produce a phosphate chemical coating of adequate film thickness onto any metal surfaces regardless of the degree of electric conductivity thereof.

DISCLOSURE OF THE INVENTION

The inventors of the present invention have conducted diligent research regarding the question of why the complicated conditions described above are necessary for the treatment of surfaces other than iron in the methods for phosphate chemical treatment according to the prior art, and further regarding why a method of treatment capable of providing an adequate thickness is not possible, and as a result we have pinpointed the cause thereof, and have also discovered a means of overcoming that cause.

In other words, according to the methods of phosphate chemical treatment of the prior art, those methods in which the material to be treated was steel have been simply applied in the same manner for other materials to be treated, and thus it was thought that the treatment conditions for materials other than steel are extremely critical, and that phosphate chemical treatment coatings could only be formed onto composite materials which include steel.

Here, according to the present invention, first the process of forming phosphate chemical treatment coatings was investigated in detail, considering the phosphate chemical treatment reaction from the following two points of view.

Since the chemical reaction by which the phosphate chemical treatment coating is formed may be understood to be an electrochemical reaction, the first analysis was made from the standpoint of the "chemical reaction".

Also, a second analysis was made regarding the phenomenon of the "phase transition". This refers to the phenomenon occurring in the phosphate chemical treatment reaction by which the soluble component (liquid) undergoes a chemical reaction to become a film (solid).

Regarding both of the investigations (analyses) mentioned above, it should be noted that the First and Second Laws of Thermodynamics play an important role in the phenomenon.

A detailed description of the results of the investigation are provided below.

First we will give the analysis from the point of view of the chemical reaction.

Phosphate chemical treatment is a kind of so-called chemical coating treatment method by which a coating is formed onto a metal surface using a chemical reaction between the metal surface and a chemical solution. Also, the chemical treatment solutions used are aqueous phosphate solutions containing coat-forming metal ions such as iron, manganese, nickel, calcium, zinc, etc.

Phosphate chemical treatment methods may be considered as comprising a step of an etching reaction on a steel material and a step of a coat-forming reaction to form a coating. These are electrochemical reactions, consisting of a cathode reaction involving the reduction of nitrate ion, etc., for example:

$$NO_3^- + 3H^+ + 2e \rightarrow HNO_2 + H_2O \quad \text{[Chemical Equation 1]}$$

$$HNO_2 + H^+ + e \rightarrow NO + H_2O \quad \text{[Chemical Equation 2]}$$

and an anode reaction involving the dissolution of the metal (etching) (Chemical Equation 3) and the forming of the coating (Chemical Equation 4):

$$Fe \rightarrow Fe^{2+} + 2e \rightarrow \Delta H \text{ (exothermic reaction)} \quad \text{[Chemical Equation 3]}$$

$$3(Zn^{2+}, Fe^{2+}) + 2H_2PO_4^- \rightarrow (Zn, Fe)_3(PO_4) + 4H^+ \text{ (endothermic reaction)} \quad \text{[Chemical Equation 4]}$$

In addition to the Chemical Equations 1–4, the balance-maintaining reactions in the chemical treatment bath include:

$$H_3PO_4 \leftrightarrows H_2PO_4^- + H^+ \quad \text{[Chemical Equation 5]}$$

$$4OH^- \rightarrow O_2 + 2H_2O + 4e \quad \text{[Chemical Equation 6]}$$

$$NO_3^- + 3H^+ + 2e \rightarrow HNO_2 + H_2O$$

It is thought that the reaction in Chemical Equation 3 acts as the main reaction in most non-electrolytic chemical treatment reactions of steel materials, and the coating is formed when the reactions in Chemical Equations 1, 2 and 4 utilizing the internal energy ($\Delta H$) released into the solution by the reaction in Chemical Equation 3, occur on the surface of the metal material (solid). Therefore, if additional energy such as heat, etc., cannot be input into the reaction system (i.e., the chemical treatment bath), then the forming of the chemical coating is accomplished by the reduction reaction on nitrogen-containing oxoacid ion such as nitrate ion, etc., represented by Chemical Equations 1 and 2, and the oxidation reaction consisting of the dissolution of iron and the oxidation of phosphate ion represented by Chemical Equations 3 and 4.

Thus, the non-electrolytic forming of chemical coatings according to the prior art in which no additional energy is supplied is carried out using only the energy ($\Delta H$) released by the dissolution of the metal material, and no chemical coating is formed beyond the energy ($\Delta H$) released by dissolution.

In contrast, the dissolution reaction in cases where the metal material used is a non-iron metal such as aluminum, copper, or the like is as follows.

$$M \rightarrow M^{n+} + ne \quad \text{[Chemical Equation 8]}$$

However, if the aluminum, for example, is immersed into a phosphate chemical treatment bath for steel materials, a pasivation film is formed on the surface of the aluminum, and therefore the aluminum does not dissolve in the phosphate chemical treatment bath, thus prohibiting the reaction in Chemical Equation 8. As a result, the energy expected to be generated by the dissolution of the aluminum surface is not produced.

In the past, when aluminum has been used as the metal material, it has been considered preferable to introduce fluoride ion ($F^-$) into the chemical treatment bath in order to promote the dissolution reaction in Chemical Equation 8.

Furthermore, when copper (Cu) has been used as the metal material in the same manner, it has been considered best to introduce a halide ion other than a fluoride ion, for example, chloride ion ($Cl^-$), into the chemical treatment bath.

Nevertheless, as described above, even if the metal material is dissolved, it has not been possible to form a favorable phosphate chemical treatment coating onto these base metal materials.

The reason for this is that, as described earlier, when employing the conventional non-electrolytic methods and electrolytic methods in treatment baths containing sludge, no technical thought has been given regarding the use of energy for the effective promotion of the entire system of phosphate chemical treatment reactions in Chemical Equations 1–8 described above, for common metal materials other than steel (such as stainless steel, copper, etc.). Consequently, no concrete measures have been undertaken for the control of the entire reaction system.

In other words, in the case of aluminum materials, the dissolution reaction $$Al \rightarrow Al^{+3} + 3e \quad \text{[Chemical Equation 9]}$$

replaces Chemical Equation 3 for steel, but in such cases it has been discovered that sufficient energy cannot be supplied to form the coating, for the reasons given below.

(1) Chemical Equation 9 proceeds at an extremely low rate if $F^-$ is not added, and the energy produced thereby is also extremely low, and therefore the entire reaction system is not established.

(2) If $F^-$ is added then Chemical Equation 9 proceeds at a sufficient rate, but a complex ($AlF_4^-$) forms between the resulting $Al^{3+}$ and $F^-$ ions and becomes stable in the solution, thus prohibiting the coat-forming reaction with aluminum which replaces Chemical Equation 4.

As described above, it has been discovered that, by considering the chemical reaction of the forming of phosphate chemical treatment coatings as an electrochemical reaction, and simply attempting to promote the reaction of Chemical Equation 8 by the addition of some chemical component, as according to the prior art, it is impossible to form phosphate chemical treatment coatings onto metal materials or electroconductive materials other than steel.

The following is an analysis from the point of view of the phenomenon of the phase transition occurring in the phosphate chemical treatment reaction.

That is, the present inventors have considered the phosphate chemical treatment reaction to be basically a "liquid phase-solid phase" reaction in which the soluble component ion (liquid) in the solution undergoes a chemical reaction to become a film (solid), believing that it may be understood in terms of a phase transition phenomenon.

However, the inventors were unable to explain the phosphate chemical treatment reactions according to the prior art in this manner, as a type of phase transition phenomenon.

This is because, in the treatment baths according to the prior art, the chemical treatment reaction is not adequately controlled, and therefore a plurality of different chemical reactions occur simultaneously in the phosphate chemical treatment bath, including a portion other than on the surface of the material to be treated. When a plurality of different chemical reactions occur in this manner, not merely a single "liquid phase-solid phase" reaction, but additional multiple "liquid phase-solid phase" reactions and "liquid phase-liquid phase" reactions also occur in the bath. As a result, sludge is included in the treatment bath. Consequently, the energy transfer between the reactions becomes complicated, and thus it is impossible to explain the forming of the film on the metal surface in terms of a phase transition phenomenon.

In other words, a thermodynamic analysis of the phase transition phenomenon is easily understood with a single-component system, such as water, but with multiple components in a complicated chemical reaction such as the reaction in a phosphate chemical treatment bath, it is very difficult to understand.

Here, the present inventors have discovered that the reaction in a phosphate chemical treatment bath may be considered in terms of a phase transition phenomenon by simplifying it to a physical phenomenon. That is, the bath is controlled to maintain a state comprising only liquid, so that the only reaction occurring in the phosphate chemical treatment bath is that of formation of the film (solid) from the components in the solution (liquid). Also, since the chemical reaction in the phosphate chemical treatment bath occurs in only a single phase (liquid) and a film (solid) is produced thereby, the phosphate chemical treatment reaction may be considered to be a phase transition phenomenon. Further, it was thought that by utilizing this in a concrete manner, it might be possible to discover a means for chemical film formation which is fundamentally different and more effective than the conventional ones.

A concrete explanation will now be provided regarding the contents of the analysis in terms of a phase transition phenomenon.

To begin with, phosphate chemical treatment entails contacting a metal material (solid) which is to be treated, with a solution (liquid) containing the components which form the film. Therefore, the reactions involved in the chemical treatment may be largely classified as:

(1) A reaction (solid phase-liquid phase reaction) between the metal material (solid phase) and the solution (liquid phase).

(2) A reaction between the components in the solution (liquid phase-liquid phase reaction).

Also, upon examination from the standpoint of thermodynamics, it is found that the phase transition phenomenon (liquid→solid) more easily occurs by the action (reaction) between the solid phase-liquid phase, than by the action (reaction) between the liquid phase-liquid phase. Likewise, for example, the condensation of moisture in the air occurs more easily onto solid surfaces (solid phase-gaseous phase) than onto the same phase (gaseous phase-gaseous phase), and this will be easily understood by considering two examples thereof, dew and frost.

In other words, the deposition of a solid by a "liquid phase-liquid phase" reaction in the solution can only occur by adding a larger amount of energy to the reaction system than is required by the "solid phase-liquid phase" reaction on the surface of the substance to be treated.

Therefore, based on the above facts, the present inventors, considering the reaction in a phosphate chemical treatment bath in terms of a phase transition reaction, restricted the energy applied to the chemical treatment reaction system to a range in which no reaction (phase transition) could occur between the liquid phase-liquid phase, while controlling it in a range in which a reaction (phase transition) could occur between the solid phase-liquid phase, and have thus first discovered the fact that it is possible to limit a chemical treatment reaction to the "solid phase-liquid phase" transition phenomenon (film formation).

Further, considering the conventional method (method of heating the treatment bath) from the standpoint of the phase transition phenomenon, when energy is applied to the treatment bath for the formation of a phosphate chemical treatment coating onto the material to be treated, since the chemical reaction in the bath is not adequately controlled, reactions (phase transitions) other than the one on the surface of the material to be treated occur due to the excess energy, and therefore sludge is formed in the bath. As a result, a plurality of solid phase-liquid phase transitions occur in the treatment bath. Consequently, the externally supplied energy cannot be used in any way to control the film thickness of the phosphate chemical treatment coating, as it simply accelerates the production of more sludge, and thus it is difficult to form a favorable phosphate chemical treatment coating onto the surface of the material being treated.

Thus, by analyzing the reaction in phosphate chemical treatment baths from 2 points of view, that is, from the point of view of both the chemical reaction and the phase transition phenomenon, it became possible for the first time to understand why favorable phosphate chemical treatment coatings with adequately controlled film thicknesses have not been able to be formed onto metal materials and electroconductive materials other than steel, using the methods according to the prior art.

Furthermore, based on the analyses described above, the present inventors have discovered how it is possible to form phosphate chemical treatment coatings with adequately controlled film thicknesses onto electroconductive metal materials.

Based on this background, the present inventors determined that the phosphate chemical treatment reaction is essentially an electrochemical reaction system and the control of the reaction should be considered with this idea as the basis.

In other words, we have succeeded in discovering a completely novel method of forming a phosphate chemical film onto an electroconductive metal surface by contacting the metal material with a phosphate chemical treatment solution containing at least phosphate ion, a nitrogen-containing oxoacid ion and a chemical film-forming metal ion, wherein the phosphate chemical treatment method is carried out in a phosphate chemical treatment bath which contains no solid matter other than the unavoidable components, and involves electrolytically treating the above mentioned metal material in the above mentioned phosphate chemical treatment bath.

As a concrete means, the method used (1) the removal of solid matter (sludge) from a chemical treatment bath and (2) an external electric power source for the reaction.

Here, the statement that the phosphate chemical treatment bath contains no solid matter other than the unavoidable components is used to mean that the bath is free of any sludge which might cause energy instability, that is, the bath is free of suspended particles which are reactive and could interfere with the reaction.

The reaction of the electrolytic treatment according to the present invention accelerates the reactions in Chemical Equations 1–8 by supplying electrical energy from the above mentioned external electric power source, and in this point it differs greatly from conventional electroplating and anodic oxidation.

The anodizing, which is one of the reactions accompanying the supplying of energy from the external power source according to the present invention, promotes the dissolution reaction of the material to be treated (Chemical Equations 3 and 8), in cases where it does not proceed naturally or adequately under the thermodynamic conditions of the solution, by applying electrical energy to the system, and thus the entire reaction system including Chemical Equations 1–8 is promoted to form the film. The anodizing accelerates the dissolution reaction of the material to be treated, and therefore it is effective for guaranteeing the adherence of the resulting chemical film.

The cathodizing, which is the other reaction which accompanies the supplying of energy from the external power source according to the present invention, guarantees the thickness of the chemical film formed, by acting on the component ions in the solution phase and depositing them onto the cathode. Consequently, since the dissolution reaction of the metal material to be treated does not occur by cathodizing alone, the cathodizing is preferably performed after the anodizing. In cathodizing, the film-forming metal material such as zinc, etc., which is used at the anode is dissolved and reacted with the phosphate ion or nitrate ion in the solution phase to form a film on the surface of the cathode (the material to be treated).

As a result, if the material to be treated which is connected to the cathode is an electroconductive material, then a phosphate chemical film may be formed on the desired metal material to be treated, by cathodizing using the specified metal material and chemical products which contain the chemical components relative to phosphate, etc., for the anode and the solution phase. Also, the cathodizing is preferably carried out after the anodizing, and thus a phosphate chemical film with excellent adherence may be formed onto common materials other than steel, such as stainless steel, magnetic materials, aluminum, copper, and the like.

Here, the anodizing definitely causes the dissolution reaction for materials capable of forming films, and thus it is effective for accelerating the formation of films. Also, application of the anodizing alone increases the adherence of the film, but since it does not create a large film thickness, it is effective for surface preparation treatment for paint-coating, etc. of steel materials. Further, by the combined use of anodizing and cathodizing (anodizing→cathodizing), the technique according to the present invention allows the formation of phosphate chemical films of adequate thickness with guaranteed adherence onto all kinds of metal materials.

For example, it may be used to produce thick phosphate films as inorganic insulation films, insulation films onto magnetic materials, lubricating foundations, rust prevention, surface preparation for painting, adhesion and plasticizing, etc. of aluminum, and the cold forging lubricating foundation, surface preparation for painting of stainless steel, etc.

The present invention is limited only to soluble components ($H_3PO_4$, $NO_3^-$, $HNO_2$, metal ions such as $Zn^{2+}$, etc.) with no sludge, in chemical treatment baths, and the substance to be treated and the electrode are placed in the treatment bath and an external power source connected between them, thus applying an electrical current between the substance to be treated (work-piece) and the electrode.

Further, the phosphate chemical treatment bath is controlled so that sludge is not produced therein.

Here, the control of the phosphate chemical treatment bath may be accomplished by, for example, the following method.

That is, the phosphate chemical treatment is preferably carried out by employing a means for controlling the input of energy into the chemical treatment bath (temperature control, control of the pressure to the liquid by controlling revolving speed of the circulation pump, stabilization of the state of energy in the solution by alternating between a state of reaction in the treatment bath and a state of no reaction therein) and filtration, etc., to create and maintain a condition in which no sludge is formed in the chemical treatment bath, and thus limit the phase transition phenomenon in the treatment bath to only the formation of the coating onto the surface of the metal being treated.

Also, according to the present invention, it is preferable to equip the phosphate chemical treatment bath cell with a filtering circulation pump and a filter.

The first purpose of the filtering circulation pump and the filter is the stabilization of the thermodynamic energy state of the solution phase of the reactive solution. If the reactive-chemical-components of the treatment bath remains in a location which allows a constant reaction site (if there is no circulation alternating between the "non-reaction site" and the "reaction site"), then the thermodynamic energy will accumulate in the solution phase as the chemical treatment reaction proceeds. As a result, the stability of the treatment bath solution phase as a liquid will be lost, and solid matter (sludge) will be produced in the solution phase. The filtering circulation pump and the filter are provided to prevent a loss of the thermodynamic stability of the solution as a liquid. Therefore, the filter itself has a specific volume, and more than simply functioning as a filter, it maintains the non-reacting state of the treatment bath for a specific period of time, and thus contributes to the thermodynamic stability of the solution phase of the entire reaction system.

The circulation of the treatment bath to alternate between the "non-reaction site" and the "reaction site" for maintenance of the thermodynamic stability of the solution phase should be considered for the entire reaction system of the phosphate chemical treatment bath (Chemical Equations 1–8), but as a representative example, an explanation is provided below regarding the equilibrium state of phosphoric acid.

A phosphate chemical treatment bath is a solution of pH (hydrogen ion concentration) of 2–4 which contains a large amount of phosphoric acid. At pH of 2–4, the phosphoric acid exists in the solution in a state of equilibrium of Chemical Equation 5.

Also, as the chemical treatment (film forming) reaction progresses, Chemical Equation 5 proceeds to the right. This is because the formation of the film occurs by the bonding of the phosphate ion which is dehydrogenated by $H_3PO_4 \rightarrow H_2PO_4^- \rightarrow PO_4^{3-}$ with metal ions such as $Zn^{+2}$ and the like, forming $Zn_3(PO_4)_2$. If the solution simply remains in the treatment cell without being circulated, then the components in the solution change such that Chemical Equation 5 shifts to the right. As a result, the chemical treatment reaction system in the solution phase (Chemical Equations 1–7) tends to produce sludge.

On the other hand, if the treatment bath is circulated, the phosphate ion in the solution, separated from the treatment cell, acts in a direction to restore the state of equilibrium (shifting Chemical Equation 5 to the left), which is the direction stabilizing the thermodynamic energy state in the solution.

Thus, the deposition of sludge in the solution phase is suppressed.

The filtering circulation pump is preferably operated while controlling the revolving speed thereof. Operating the circulation pump at a high revolving speed applies a high pressure to the solution phase. As a result, the energy of the solution phase increases to a point where the solution phase can no longer be maintained in a liquid state, and finally solid matter (sludge) is deposited. Conversely, if the revolving speed is too low, then a large-capacity pump must be provided, thus raising the cost. Therefore, if the circulation pump is a conventional centrifugal pump, an inverter is preferably used to appropriately control the revolving speed, in order to suppress the pressure of the solution phase while ensuring the proper circulation volume.

The second purpose of the filtering circulation pump and the filter is the removal of sludge which is produced in the treatment bath. If the produced sludge, particularly energy-unstable sludge, is allowed to remain, then the treatment bath tends to produce even more sludge. It is thus preferable to rapidly remove sludge which is produced.

Also, the temperature regulation of the chemical treatment reaction system is preferably effected slowly.

The temperature of the chemical treatment bath according to the present invention is in a range of about 20°–35° C. This temperature range is roughly in the range of normal room temperature, and of normal aqueous solutions. However, heating will be required during the winter to maintain the prescribed temperature. What is important according to the present invention is not the use of heating to accelerate the reaction. That is, the temperature range of 20°–35° C. for the chemical treatment reaction system is a necessary condition for the control of the chemical treatment reaction, and it is not directly used as thermal energy for the chemical treatment reaction. Presently, the method of heating the phosphate chemical treatment bath to a temperature of 40° C. or greater involves placing a heat exchanger into the chemical treatment bath to provide steam as a heat source for direct heating of the chemical treatment bath. In this method, since the vicinity of the heat exchanger rises to a very high temperature, the decomposition of the components in the chemical treatment bath is accelerated by the heat in that area, and sludge is produced. In this point, the significance of the heating clearly differs.

In the method according to the present invention, the suppression of sludge production is the first consideration. Therefore, the introduction of a direct heat source into the chemical treatment bath is not preferred. Also, the chemical treatment bath should be warmed as slowly as possible, and indirectly. Specifically, the preferred method is to provide a heat exchanger in the treatment bath circulation cycle of the electrolytic chemical treatment reaction system, and to effect warming while the circulation pump is in operation. Also preferable is a method by which the entire treatment cell is surrounded by water at about 30°– 40° C.

In the method according to the present invention, the hydrogen ion concentration (PH), the oxidation-reduction potential (ORP), the electric conductivity (EC) and the temperature, etc., of the chemical treatment bath are preferably measured, and the chemical solution added in response to changes therein, to constantly maintain each of the component ions in the chemical treatment bath within the prescribed concentration ranges. Also, the sensors for the pH, ORP, EC and temperature are preferably located away from the treatment cell. According to the present invention, an electrolytic reaction occurs in the treatment cell using an external power source. Therefore, the electric current flowing in the treatment cell influences nearby sensors, making the display of accurate values impossible.

It is most preferable to control the bath in the manner described above so that absolutely no sludge accumulates in the phosphate chemical treatment bath, but even if reactive substances have accumulated at the bottom of the treatment cell after the reaction has reached an energy-stable state, as the unavoidable components of the solid matter in the chemical treatment bath, the bath itself may simply be kept free of impurities. This is because such stably accumulated, energy-stable sludge exerts practically no influence on the ion components in the solution in which the reaction takes place.

In the case of the present invention, since an electric current is applied to the treatment bath, the treatment bath exists in an electric field which is in a saturated state due to the constant application of electrical energy, and therefore the solid matter produced therein continues to solidify until it becomes energy-stable, without floating in the treatment bath in an intermediate state. In other words, each of the components in the treatment bath becomes either energy-stable solid matter (sludge or film), or an energy-stable soluble component in solution, and even if sludge is produced, it is stable and remains at the bottom of the cell.

As a result, by the method of electrolysis of a clear treatment bath according to the present invention, the treatment bath may be maintained in a constantly stable state containing no unstable (energy-intermediate) sludge.

A more detailed explanation will now be given regarding the method of electrolysis by which the present invention is characterized.

The electrolysis according to the present invention is preferably direct current electrolysis.

The electrolysis is divided into the following types, depending on the site (electrode) connected to the substance to be treated (work).

(1) Anode electrolysis: Electrolysis with the work-piece as the anode.

(2) Cathode electrolysis: Electrolysis with the work-piece as the cathode.

(3) Anode electrolysis+cathode electrolysis

Also, a combination of any of the above methods of electrolysis with a non-electrolytic method of forming a film may be used.

The electrolytic chemical treatment system according to the present invention will now be described with reference to FIGS. 1–4.

According to the present invention, the electrolytic system in FIGS. 1–4 may be considered.

Here, each of the electrolytic chemical treatment systems in the figures comprises a treatment cell 1, a circulation pump 2, a filter 3, a sensor 4, a power source 5, an electrode 6, a substance to be treated 7 and a temperature controlling system 8. The electrolytic reaction system consists of one or more subsystems, and if it consists of 2 or more subsystems, then it is divided into a main electrolysis (reaction) system A and a secondary electrolysis (reaction) system B. Also, the secondary electrolysis (reaction) system B is sometimes in the same cell and sometimes in a separate cell.

FIG. 1 is a normal electrolytic treatment system. In this case, the electrode and the substance to be treated are sometimes exchanged.

FIG. 2 is a system comprising a main electrolysis system A and a secondary electrolysis system B. Also, FIG. 2 is an electrolytic treatment system in which cathodizing is performed.

The system is constructed so that a voltage/current is applied to the main electrolysis system A, but no voltage or current is directly applied to the secondary electrolysis system. The secondary electrolysis system B is constructed so that the current from the external circuit does not flow directly via the wire from the substance to be treated 7 to the electrode 10 and the electrode 11, etc.

The electrical current which is applied to the main electrolysis system A flows through the solution to the substance to be treated 7 and to the electrodes 10, 11 which are the opposite electrodes of the secondary electrolysis system. Also, the current flowing to the opposite electrodes of the secondary electrolysis system B (electrodes 10 and 11) reaches the substance to be treated 7 again via the solution. Further, part of the current which flows to the opposite electrodes of the secondary electrolysis system B reaches the substance to be treated 7 via a diode D. The main electrolysis system A functions as the electrolytic reaction which is directly connected with the formation of the chemical film, while the secondary electrolysis system B functions to favorably promote the main reaction.

The reason for this is as follows. In the electrolysis system which has been connected as shown in FIG. 2, the electric potential in the treatment bath during the electrolytic treatment (application of the electric current) is such that "the anode of the main electrolysis system A">"the opposite electrodes of the secondary electrolysis system B">"substance to be treated 7". Also, by operating the main electrolysis system A, not only the metal ions in the main electrolysis system A, but also the metal ions in the secondary electrolysis system B, being linked to the main electrolysis system A, can be deposited onto the surface of the substance to be treated.

The main electrolysis system A is constructed with the main metal used to form the phosphate coating, such as zinc, as the electrode 6 at the anode end, and the substance to be treated 7 as the cathode. The secondary electrolysis system B is constructed with metal materials such as iron and nickel, etc., which are to form secondary components of the phosphate chemical coating, immersed in the treatment bath as the electrodes. Consequently, the iron and nickel also dissolve in the treatment bath by the action of the main electrolysis system A, and the dissolved ions will be deposited along with zinc as phosphate salts on the surface of the substance to be treated, forming a film.

Furthermore, if the metal materials such as iron, nickel, etc., are simply immersed in the bath without being connected in the manner shown in FIG. 2, then the iron will remain immersed in the electrolysis system, and as a result the amount of iron dissolving and being deposited will increase, thus producing a rough film with inferior properties. That is, in such a case the dissolution and deposition of the iron will be less linked to the dissolution and deposition of the zinc, than in the case shown in FIG. 2.

It is well known that iron ion plays an important role in the formation of phosphate films, but an overly large amount thereof is also inconvenient.

As shown in FIG. 2, due to the connecting wire, the electric current applied to the main electrolysis system (between the Zn electrode and the substance to be treated) A is also applied to the electrodes 10 and 11 in the same treatment bath, and the current consists of a portion which is released into the treatment bath and a portion of the current which flows from the iron and nickel to the substance to be treated 7 via the external wire. As a result, the dissolution of the iron due to electrolysis in the chemical treatment bath is reduced compared with the case where a direct current flows to the bath from the iron electrode. Consequently, the resulting chemical film has its iron component minimized, and is thus more dense.

For the electrodes 10, 11 of the secondary electrolysis system B may be used iron and nickel in combination, or either one alone, or another metal. Also, the diode D in FIG. 2 may be arranged in the opposite direction.

FIG. 3 shows a case in which the main electrolysis system A and the secondary electrolysis system B are prepared in separate cells.

In this case, if anodizing is carried out with a constant voltage of 0.5 V or less applied to the substance to be treated (iron) 7 in the main electrolytic cell 13, then the excess ferrous ion ($Fe^{2+}$) dissolves in the reaction system, but when the anodizing voltage is too low then the dissolved $Fe^{2+}$ is not oxidized to ferric ion ($Fe^{3+}$). Consequently, the oxidation-reduction potential (ORP) of the treatment bath is lowered. If it is attempted to control the ORP of the treatment bath to 560 mV or greater, then it will be necessary to oxidize the $Fe^{2+}$ to $Fe^{3+}$, as described in detail later.

The secondary electrolytic cell 14 in FIG. 3 is provided for this purpose. That is, the excess $Fe^{2+}$ which is eluted into the reaction system by the electrolytic reaction in the main electrolytic cell 13 is converted from $Fe^{2+} \rightarrow Fe^{3+}$ in the secondary electrolytic cell 14 by electrolysis at a greater voltage and current, and thus the ORP of the treatment bath may be controlled within a prescribed range of 560 mV or greater.

FIG. 4 shows a case in which a plurality of main electrolysis systems A are provided. The anodes are an electrode 7 using zinc and an electrode 15 using another metal (iron, etc.), and the substance to be treated 6 is connected as the cathode. Also, this case allows the simultaneous electrolytic treatment of a plurality of metals for the formation of a chemical films thereon.

An explanation will now be given regarding the method of applying the electric current and voltage. The following methods may be mentioned for the application of the electric current and voltage to the bath from the power source 5.

A summary thereof is shown in FIGS. 5 (*a*)–5 (*d*).

(a) Constant current electrolysis: method wherein a constant current is applied (including pulse electrolysis).

(b) Constant voltage electrolysis: method wherein a constant voltage is applied (including pulse electrolysis).

(c) Current scanning electrolysis: method of electrolysis wherein the applied current is controlled (scanned) using a function generator or the like, to produce a specified current after a specified period of time. Sometimes repeated n number of times.

(d) Voltage scanning electrolysis: method of electrolysis wherein the applied voltage is controlled (scanned) using a function generator or the like, to produce a specified voltage after a specified period of time. Sometimes repeated n number of times.

Electrolytic methods (a), (b), (c) and (d) may be carried out at the anode or the cathode, and thus there are actually 8 possible methods, as shown in Table 1.

In actual practice, any one of the 8 methods may be used alone, or any number of the 8 methods may be used in combination as a series of steps.

Also, a non-electrolytic method may be used in combination with one of the electrolytic methods mentioned above.

TABLE 1

Combination of Electrolytic Methods

| | Anode electrolysis | Cathode electrolysis |
|---|---|---|
| Constant current electrolysis | (1) | (2) |
| Constant voltage electrolysis | (3) | (4) |
| Current scanning electrolysis | (5) | (6) |
| Voltage scanning electrolysis | (7) | (8) |

The electrolytic treatment according to the present invention results in the production of less sludge than in the case of non-electrolytic baths. This is due to the fact that the electrical energy supplied to the bath raises the electrochemical energy level of the bath as a whole, and greater stability of the individual component ions in liquid state is made possible. That is, in a clear electrolytic bath, the supply of electrons (e) to the solution phase contributes to the stabilization of the various ions in the solution phase. Consequently, since the various ions are stable in this clear electrolytic bath, the solution is also thermodynamically stable. As a result, in order to cause a phase transition (corresponding in this case to a "liquid-solid" reaction) such as the formation of a coating, etc., a larger amount of electrochemical energy is required than for a clear non-electrolytic bath. Therefore, in comparison with non-electrolytic baths, the electrolytic treatment according to the present invention provides greater stability for the solution and is less likely to produce sludge.

The voltage and current applied during the electrolytic treatment are preferably about 0.1 V–10 V and 10 mA/dm$^2$ - 4 A/dm$^2$, respectively. Also, the preferred electrolysis is carried out by insuring the maximum amount of current with as low a voltage as possible.

The oxidation-reduction potential of the phosphate chemical treatment bath according to the present invention (expressed as the AgCl electrode potential) is preferably 250–650 mV. Also, the 250–650 mV in the present invention preferably corresponds to 460–860 mV of a hydrogen standard electrode potential.

If the treatment is limited to steel materials, then the oxidation-reduction potential of the chemical treatment bath reflects the entirety of the various equilibrium systems in the treatment bath, but reflects Chemical Equation 4 as regards the $Fe^{2+}$ ion. That is, if the amount of a soluble metal ion, particularly $Fe^{2+}$, is increased, then the oxidation-reduction potential will be reduced, while conversely if the amount of soluble metal ion, particularly $Fe^{2+}$, is decreased, then the oxidation-reduction potential will be increased. Also, if during non-electrolysis there is no supply of energy such as heating, etc., then an oxidation-reduction potential will not reach 560 mV or greater. This is because the AgCl electrode potential according to the present invention is about 210 mV less than the hydrogen standard electrode potential, and an ORP (AgCl electrode potential) of 560 mV corresponds to 770 mV in terms of the hydrogen standard electrode potential, and that potential reflects the equilibrium:

$$Fe^{2+} \rightarrow Fe^{3+} + e + 0.77\ V \qquad \text{[Chemical Equation 10]}$$

In other words, for an ORP of 560 mV or greater, it is necessary to further oxidize the ferrous ion ($Fe^{2+}$) dissolved from the iron material. However, if thermal energy is not directly used to form the coating in the non-electrolytic bath, then the only energy supplied to the treatment bath is the energy which accompanies the dissolution of the iron (Chemical Equation 3). With that energy alone, the equilibrium of Chemical Equation 10 cannot be shifted towards the right.

However, since according to the present invention electrical energy is supplied by the electrolytic treatment, the iron is dissolved and oxidized by Chemical Equations 3 and 10, causing the treatment bath to contain both $Fe^{2+}$ and $Fe^{3+}$, and so the ORP may be 560 mV or greater. In addition, the reaction of the formation of the film (Chemical Equation 4) is also promoted, and thus the formation of the chemical film takes place. Since $Fe^{3+}$ is stably present in the bath with an ORP of 560 mV or greater, the chemical treatment coating which is formed is assumed to be a phosphate chemical coating including iron in the form of both $Fe^{2+}$ and $Fe^{3+}$.

Furthermore, at 250 mV or less, the amount of the soluble metal ion becomes too large causing sludge to be easily produced in the treatment bath, and thus making it difficult to maintain the clarity of the chemical treatment bath. As a result, a strong chemical film cannot be formed.

Even if metal materials other than steel are to be treated, the oxidation-reduction potential of the chemical treatment bath is generally in the range of 250–650 mV. This is because the oxidation-reduction potential reflects the balance of oxidation-reduction of Chemical Equations 1, 2, 4 and 8 in the treatment bath, and even if Chemical Equation 8 is generalized to Chemical Equation 3, the balance of the oxidation-reduction of Chemical Equations 1, 2 and 4 does not change very greatly.

The chemical film treatment bath according to the present invention preferably contains phosphate ion at about 4 g/l (grams/liter) or more, the film-forming metal ion at about 1.5 g/l or more, and nitrate ion at about 3 g/l or more. On the other hand, preferably the maximum limit of phosphate ion is usually about 150 g/l, the maximum limit of the film-forming metal ion is usually about 40 g/l, and the maximum limit of nitrate ion is usually about 150 g/l. Furthermore, the most preferred ion concentrations are usually about 5–80 g/l of phosphate ion, 2–30 g/l of the film-forming metal ion, and 10–60 g/l of nitrate ion.

The management of the chemical treatment bath basically involves the control of the oxidation-reduction potential. Hence, it is preferable to add main reagents (an acidic chemical containing phosphoric acid, nitric acid, zinc, etc.) in response to the change in the oxidation-reduction potential; however, for a stricter management of the chemical treatment bath, it is preferable to additionally utilize the other electrochemical parameters of the chemical treatment bath, such as the hydrogen ion concentration (PH) and the electric conductivity (EC).

The hydrogen ion concentration (PH) is preferably in a range of about 2.5–4.0.

Raising of the PH is accomplished by introducing a chemical such as caustic soda which will shift the treatment bath towards the alkaline end. Conversely, lowering of the PH is accomplished by introducing more of the main reagents, i.e., the acidic chemical containing phosphoric acid, nitric acid, zinc, etc.

The suitable range of the electric conductivity varies depending on the type of chemical treatment bath. It is preferably set higher for baths containing large amounts of active ion such as nitrate ion, and set lower for baths containing small amounts of nitrate ion or the like but large amounts of phosphate ion. It is generally preferable to add the main reagents at a minimum set value of conductivity so as to adjust the conductivity of the chemical treatment bath within a specific range. The electric conductivity also varies depending on the structure of the ions in the chemical treatment bath, and the conductivity will decrease as the ions in the solution become more structured, even if the composition does not change. In light of the above, the conductivity of the chemical treatment bath is preferably controlled to about 10–200 mA/dm$^2$.

According to the present invention, there is provided a method for phosphate chemical treatment which makes it possible to produce a phosphate chemical coating of adequate film thickness onto metal surfaces regardless of the degree of electric conductivity thereof.

BRIEF DESCRIPTION OF THE DRAWINGS

FIG. 24 is an SEM photograph of the crystalline structure of a phosphate film obtained by the method in Example 8;

BEST MODE FOR CARRYING OUT THE INVENTION

Figure 1:
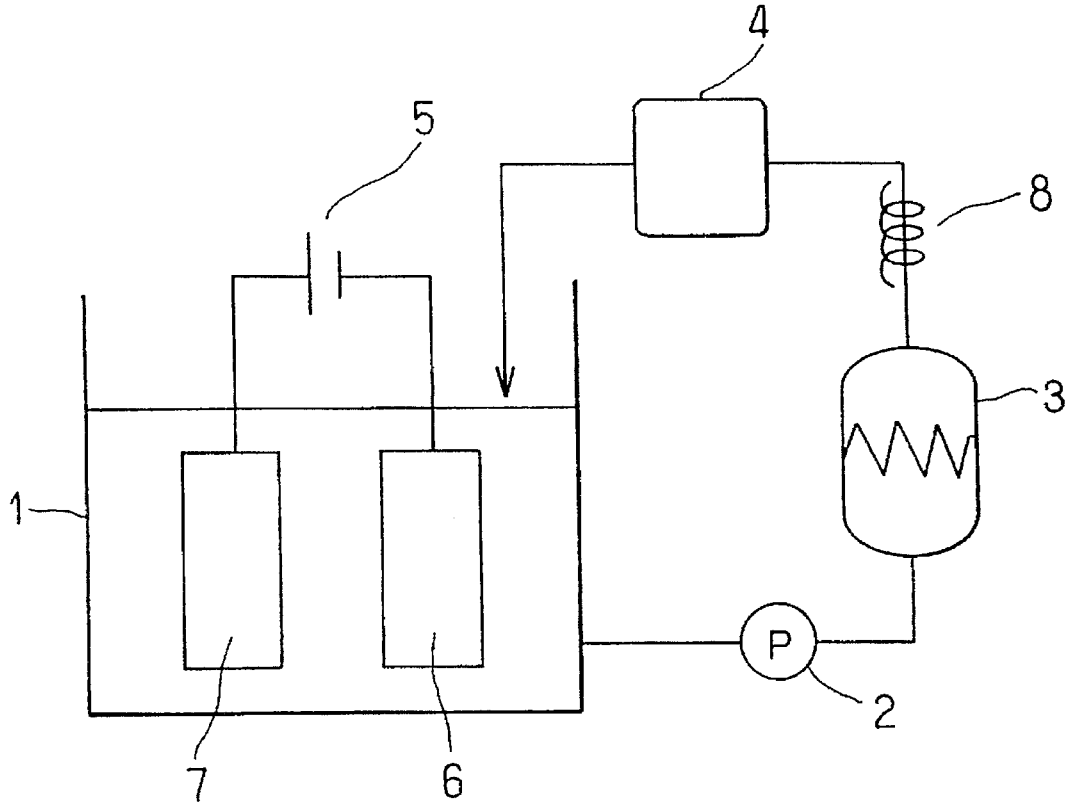
FIG. 1 is a schematic drawing of an electrolytic treatment system for phosphate chemical treatment.

In Examples 1–6 and 8–10 according to the present invention, the materials to be treated were a flat test piece (A) with a length, width and thickness of 15 cm, 7 cm and 1 mm, respectively, and a test piece (B) of 7.5 cm, 3.5 cm and 1 mm, respectively, and the opposite electrodes were flat having a length, width and thickness of 20 cm, 5 cm and 1–2 mm, respectively.

Also, in Example 7 a clutch from an automobile air conditioner compressor was used.

In Example 11 a part (core segment) was used made of a magnetic material (ILSS), which is used to form a solenoid stator core for controlling an automobile fuel injection pump.

In Example 12 a magnetic material (ILSS) was used from the same type of solenoid core segment used in Example 11, of length 500 mm, width 28 mm and thickness 2 mm prior to cold-forging.

In Example 13 the stator core of an automobile alternator was used. The amount of the treatment bath used for the treatment was about 20 liters in all cases.

The treating time of the test pieces in each of the Examples was 2 minutes for each step, except for the phosphate chemical treatment, and the process is the following: degreasing→water washing→water washing→acid washing (1–2% $HNO_3$, normal temperature, 1–2 minutes) →water washing→water washing→surface preparation (0.1–0.2% PL-ZT, product of Nihon Parkerizing) →phosphate chemical treatment→water washing→water washing. The times for the phosphate chemical treatment differed between each of the Examples and the Comparison. The water washing after the degreasing was followed by spraying with fresh water for industrial use, to ensure thorough washing.

Also, in Examples 5, 6, 7–13 and the Comparison, there was no acid washing or water washing following it.

The Examples and the Comparison are summarized in Tables 2 and 3.

Also, the ORPs (oxidation-reduction potentials) referred to in the Examples are all AgCl electrode potentials. Further, in cases where the AgCl electrode potential is substituted by the hydrogen standard electrode potential, approximately 210 mV is added thereto.

Furthermore, FIGS. 6, 9, 12, 15, 18, 20, 22, 24, 26 and 28, which are the SEM photographs of the phosphate chemical treatment films obtained by each of the Examples, are all at 1,000-fold magnification.

TABLE 2

Figure 6:
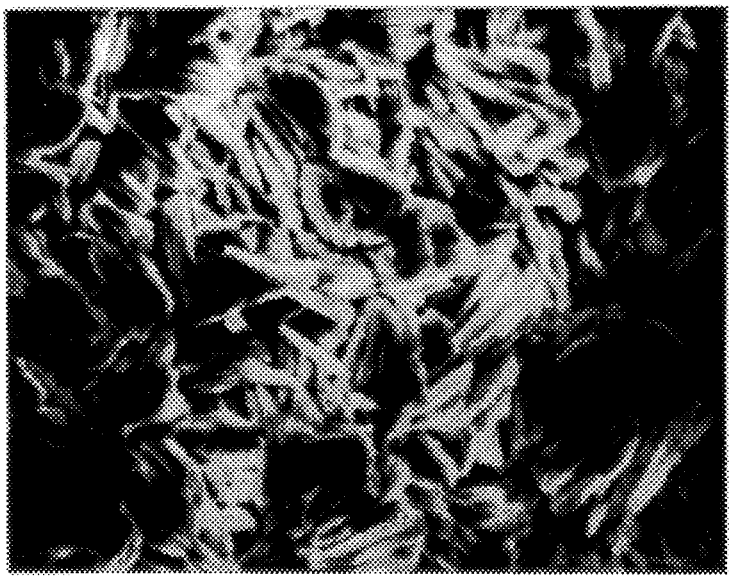
FIG. 6 is an SEM photograph of the crystalline structure of a phosphate film obtained by the method in Example 1.
Figure 9:
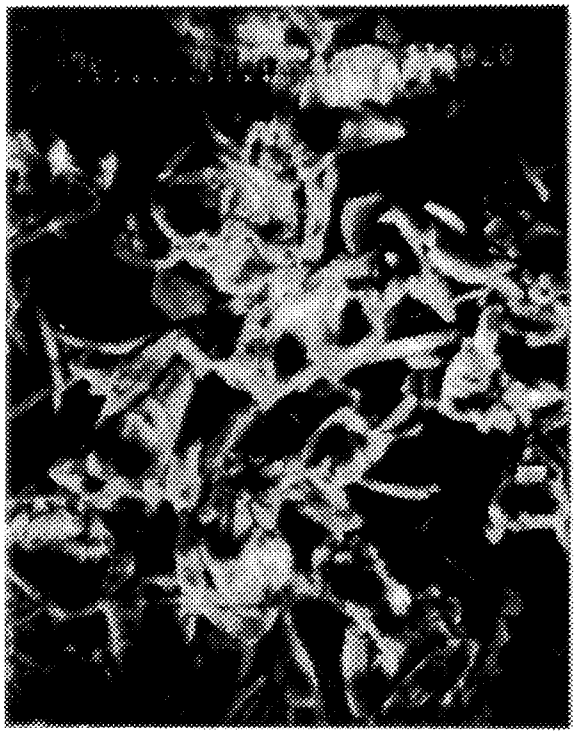
FIG. 9 is an SEM photograph of the crystalline structure of a phosphate film obtained by the method in Example 2.
Figure 7:
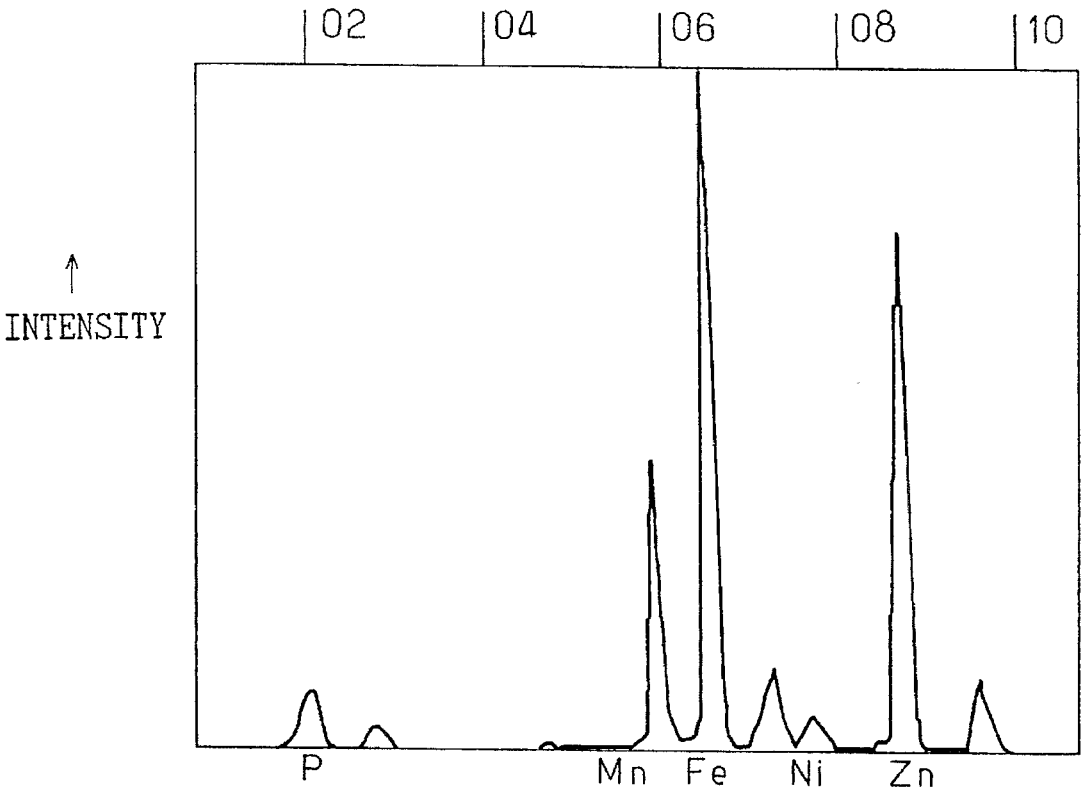
FIG. 7 is a fluorescent X-ray analysis chart for a phosphate film obtained by the method in Example 1.
Figure 8:
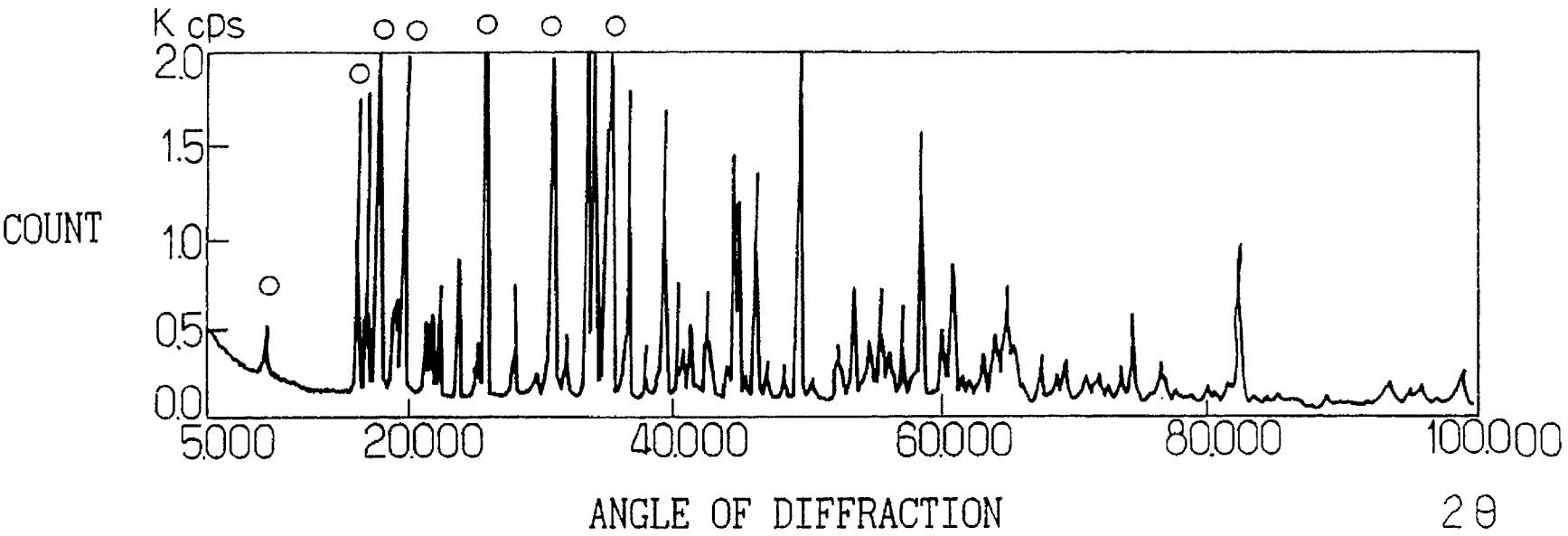
FIG. 8 is an X-ray diffraction chart for a phosphate film obtained by the method in Example 1.
Figure 10:
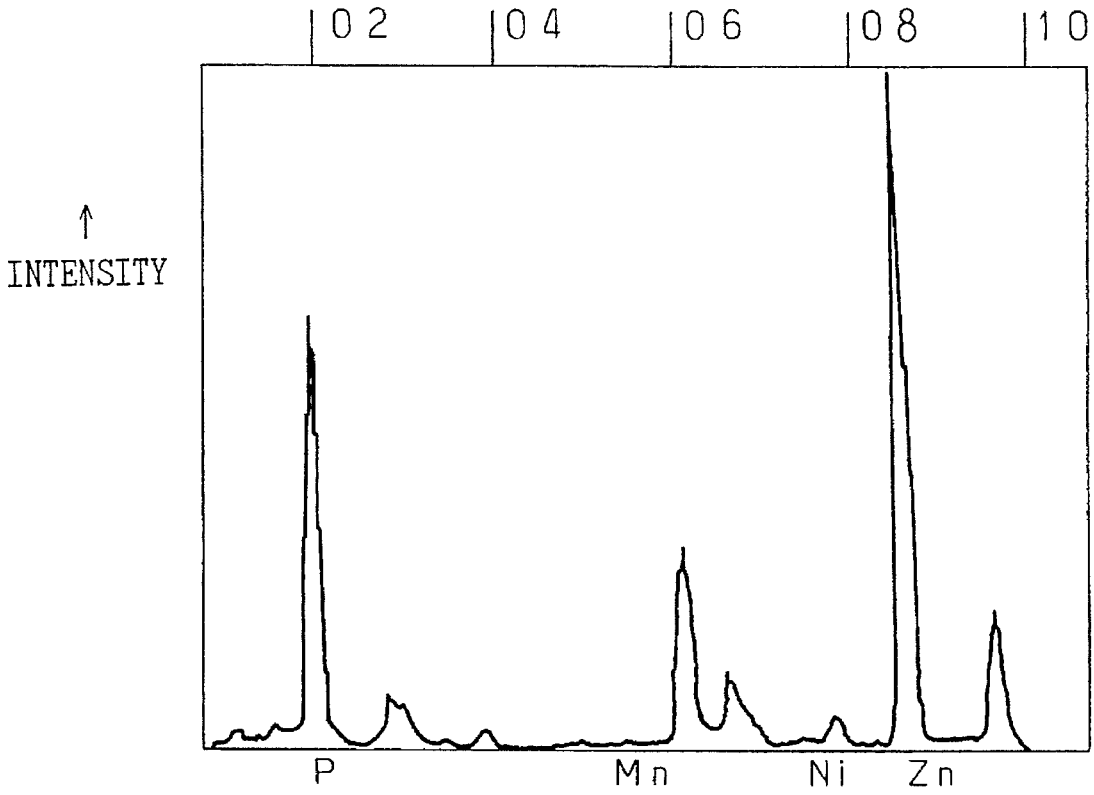
FIG. 10 is a fluorescent X-ray analysis chart for a phosphate film obtained by the method in Example 2.
Figure 11:
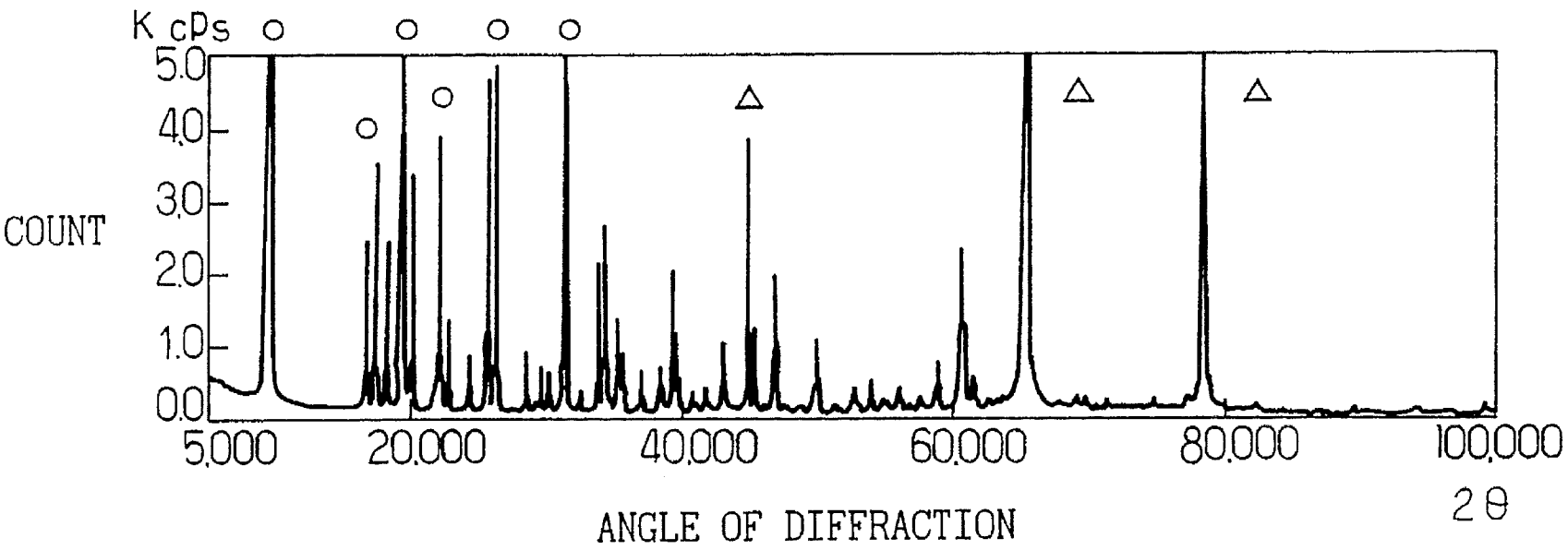
FIG. 11 is an X-ray diffraction chart for a phosphate film obtained by the method in Example 2.
Figure 12:
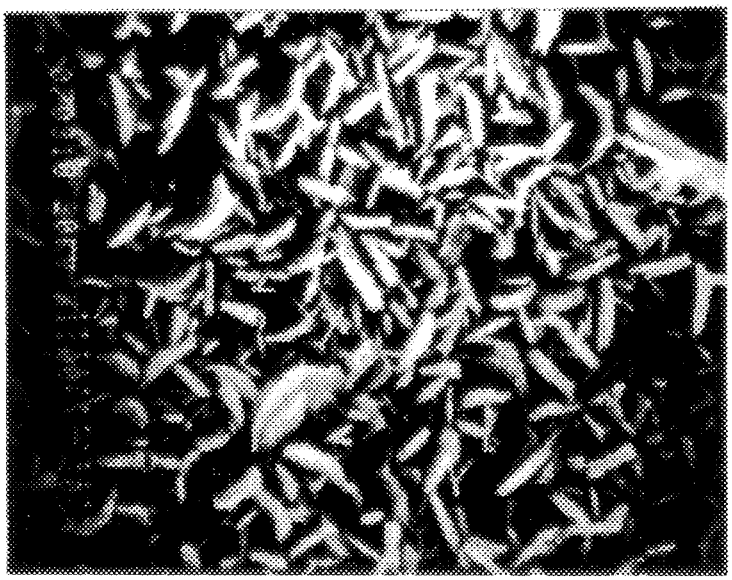
FIG. 12 is an SEM photograph of the crystalline structure of a phosphate film obtained by the method in Example 3.
Figure 15:
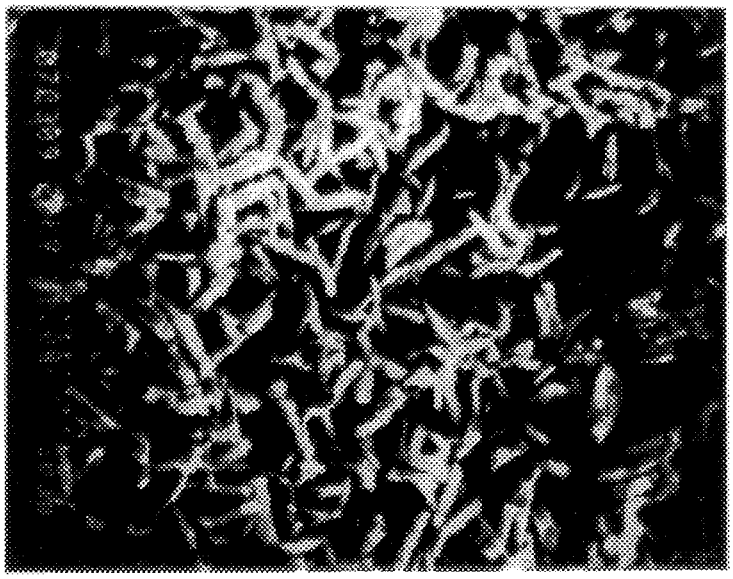
FIG. 15 is an SEM photograph of the crystalline structure of a phosphate film obtained by the method in Example 4.
Figure 13:
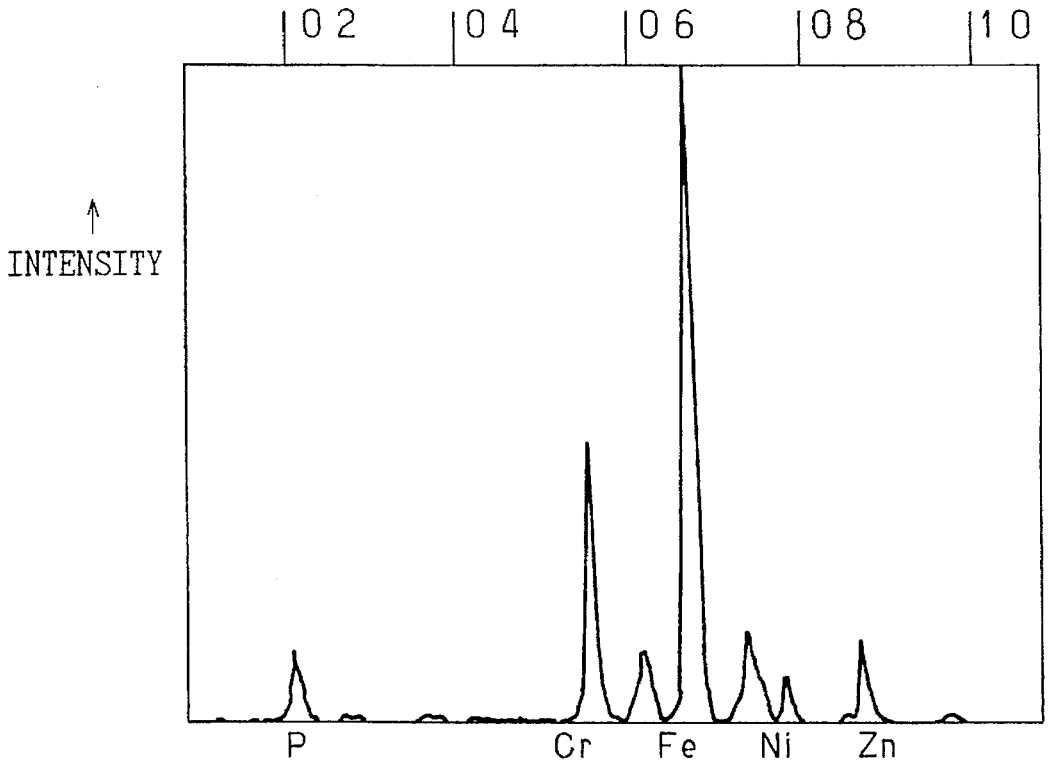
FIG. 13 is a fluorescent X-ray analysis chart for a phosphate film obtained by the method in Example 3.
Figure 14:
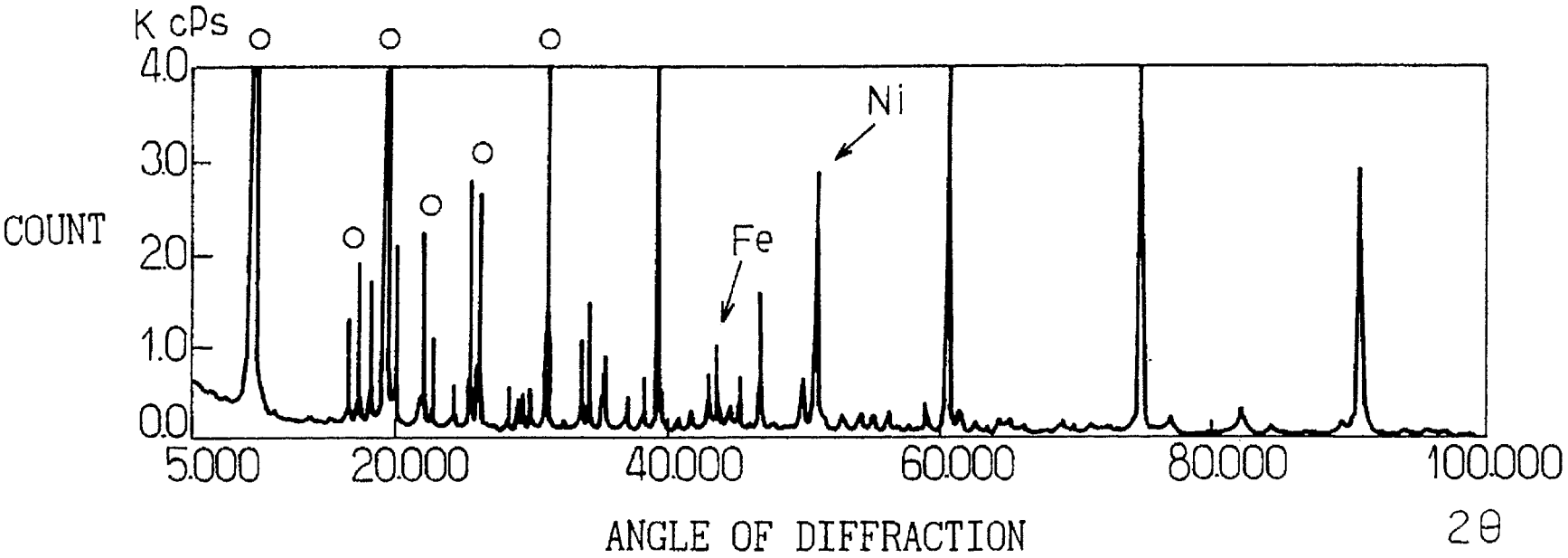
FIG. 14 is an X-ray diffraction chart for a phosphate film obtained by the method in Example 3.
Figure 16:
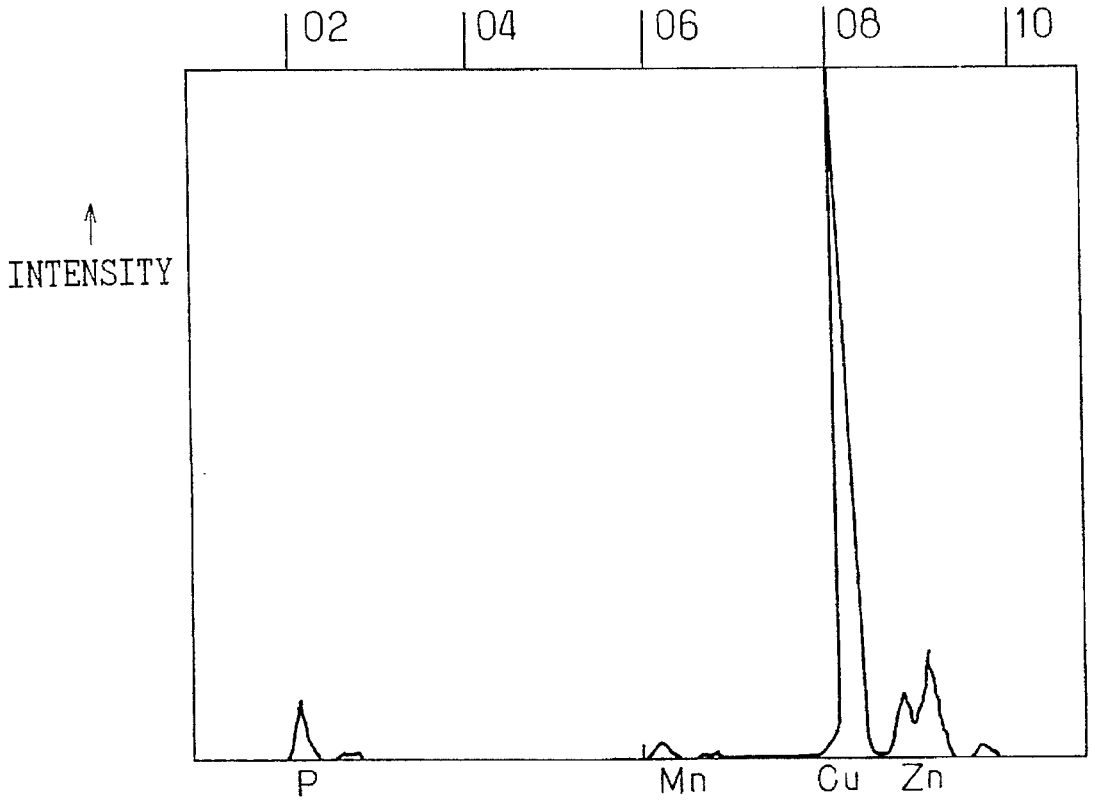
FIG. 16 is a fluorescent X-ray analysis chart for a phosphate film obtained by the method in Example 4.
Figure 17:
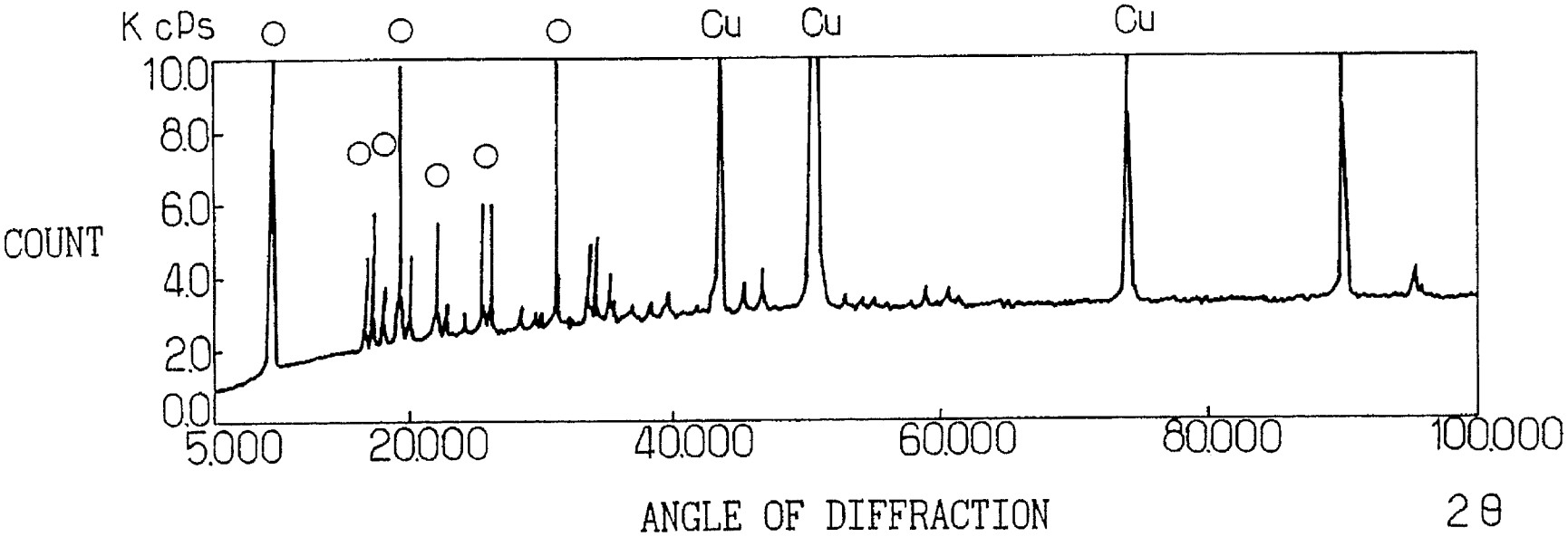
FIG. 17 is an X-ray diffraction chart for a phosphate film obtained by the method in Example 4.
Figure 18:
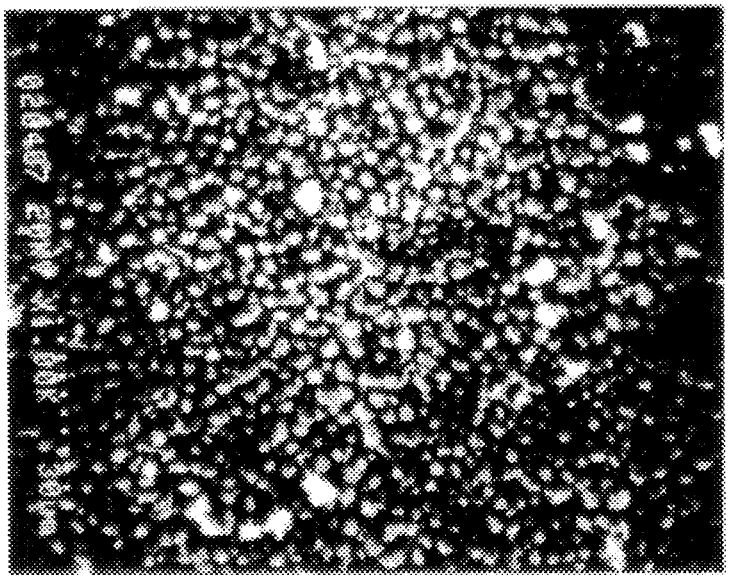
FIG. 18 is an SEM photograph of the crystalline structure of a phosphate film obtained by the method in Example 5.
Figure 20:
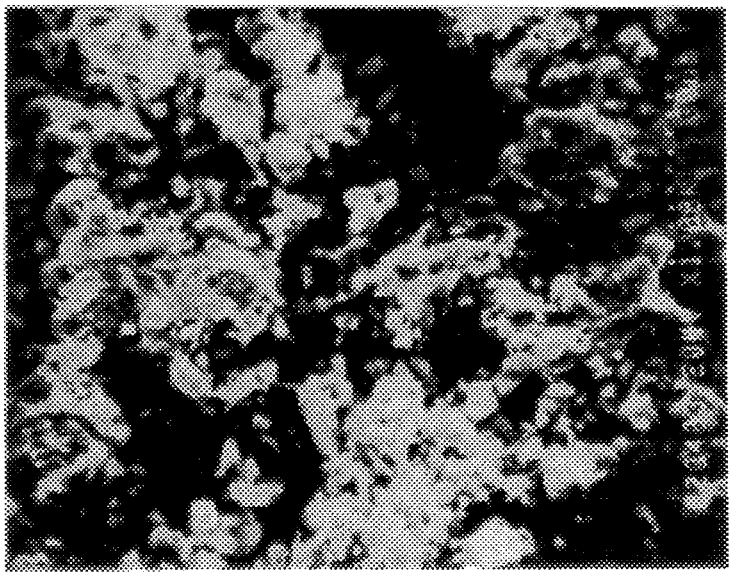
FIG. 20 is an SEM photograph of the crystalline structure of a phosphate film obtained by the method in Example 6.
Figure 19:
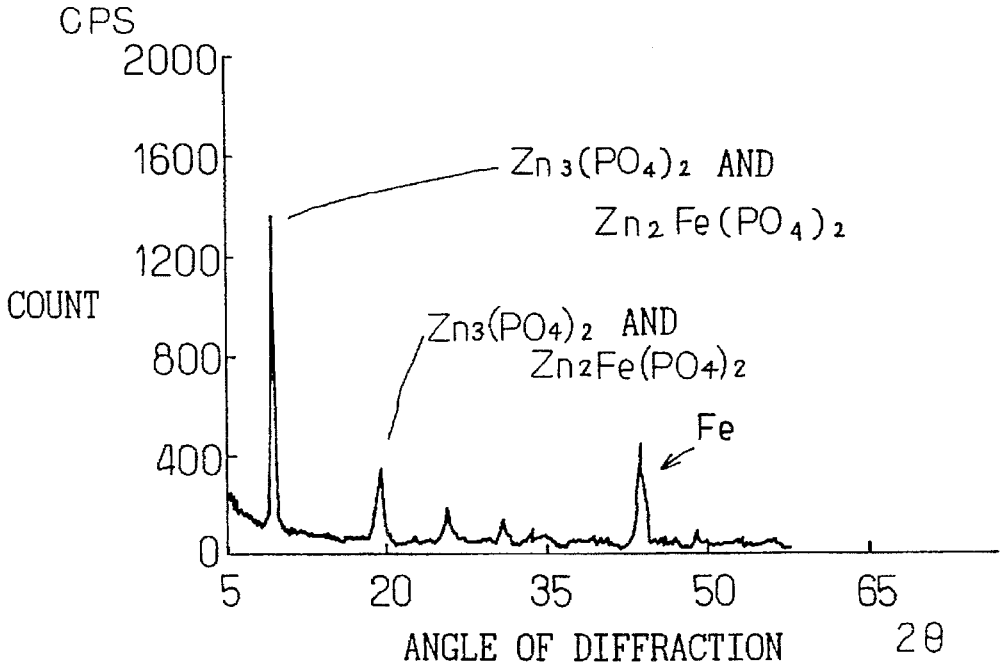
FIG. 19 is an X-ray diffraction chart for a phosphate film obtained by the method in Example 5.
Figure 21:
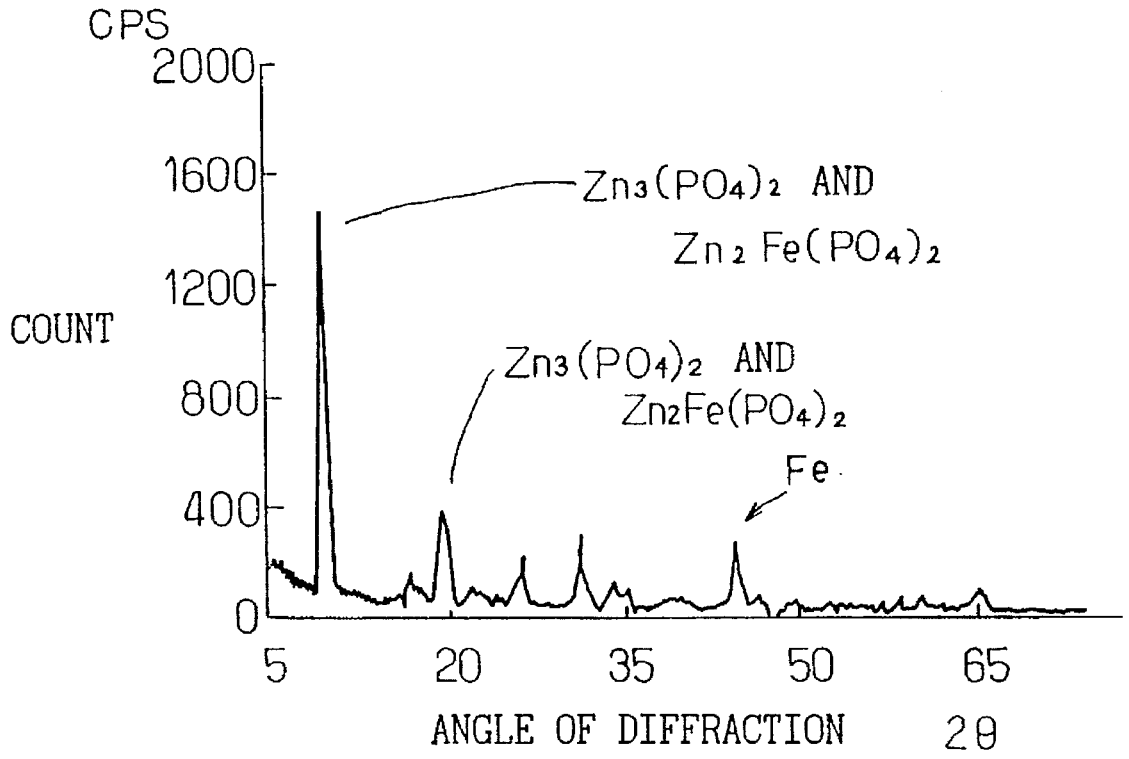
FIG. 21 is an X-ray diffraction chart for a phosphate film obtained by the method in Example 6.
Figure 22:
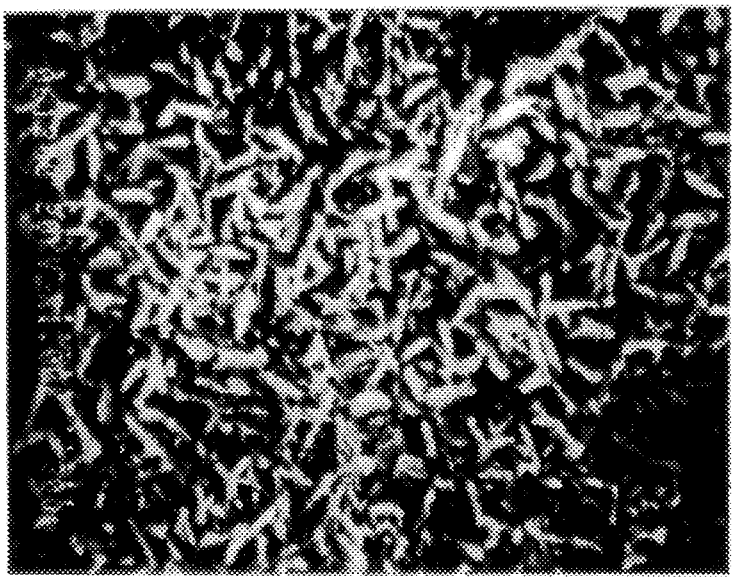
FIG. 22 is an SEM photograph of the crystalline structure of a phosphate film obtained by the method in the Comparison.
Figure 23:
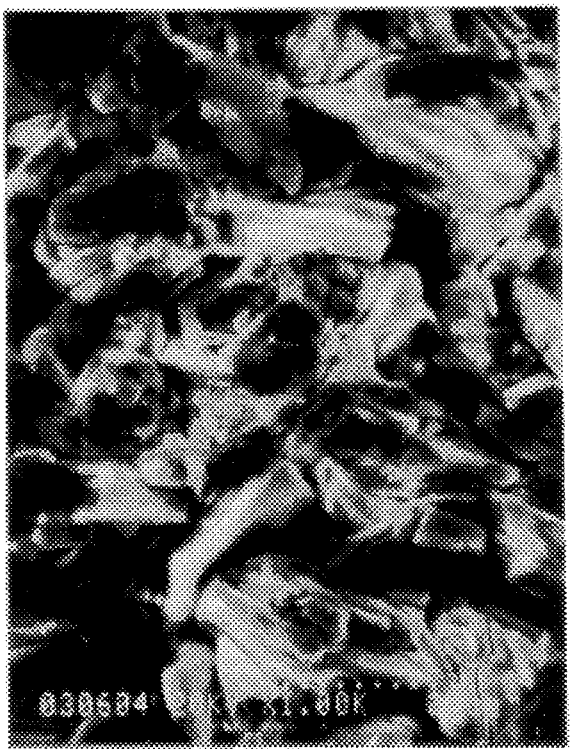

| | Sample | Example 1 | Example 2 | Example 3 | Example 4 | Example 5 | Example 6 | Comparison |
|---|---|---|---|---|---|---|---|---|
| | Material to be treated | Steel | Aluminum | Stainless | Copper steel (SUS304) | Steel | Steel | Steel |
| Step 1 Anodizing | Opposite electrode | Zinc | Steel | Steel | Steel | Steel | Steel | None |
| | Anode electrolysis | No –*1 | Yes | Yes | Yes | Yes | Yes | — |
| | Electrolytic treatment system | — | FIG. 1 | FIG. 1 | FIG. 1 | FIG. 1 | FIG. 1 | — |
| | Current/voltage application method | *–2 — | B | B | B | B | B | — |
| | Treatment temperature °C. | 30° C. | 25–30 | 25–30 | 25–30 | 25–30 | 25 | — |
| | Transparency (cm) | 30 cm + | 30 cm + | 30 cm + | 30 cm + | 30 cm + | 30 cm + | 30 cm + |
| Step 2 Cathodizing | Opposite electrode | Zinc | Iron | Iron | Iron | Iron | Iron | — |
| | Cathode electrolysis | Yes | Yes | Yes | Yes | No | Yes | No |
| | Electrolytic treatment system | FIG. 1 | FIG. 1 | FIG. 1 | FIG. 1 | — | FIG. 1 | — |
| | Current/voltage application method | *–2 B | B | B | B | — | B | — |
| | Treatment temperature °C. | 28 | 25–30 | 25–30 | 25–30 | 25–30 | 25 | 28 |
| | Transparency (cm) | 30 cm + | 30 cm + | 30 cm + | 30 cm + | 30 cm + | 30 cm + | 30 cm + |
| | SEM photograph | FIG. 6 | FIG. 9 | FIG. 12 | FIG. 15 | FIG. 18 | FIG. 20 | FIG. 22 |
| | Fluorescent X-ray chart | FIG. 7 | FIG. 10 | FIG. 13 | FIG. 16 | — | — | — |
| | X-ray diffraction chart | FIG. 8 | FIG. 11 | FIG. 14 | FIG. 17 | FIG. 19 | FIG. 21 | — |

*–1 Performed non-electrolytically
*–2 As shown in FIG. 5

TABLE 3

Figure 2:
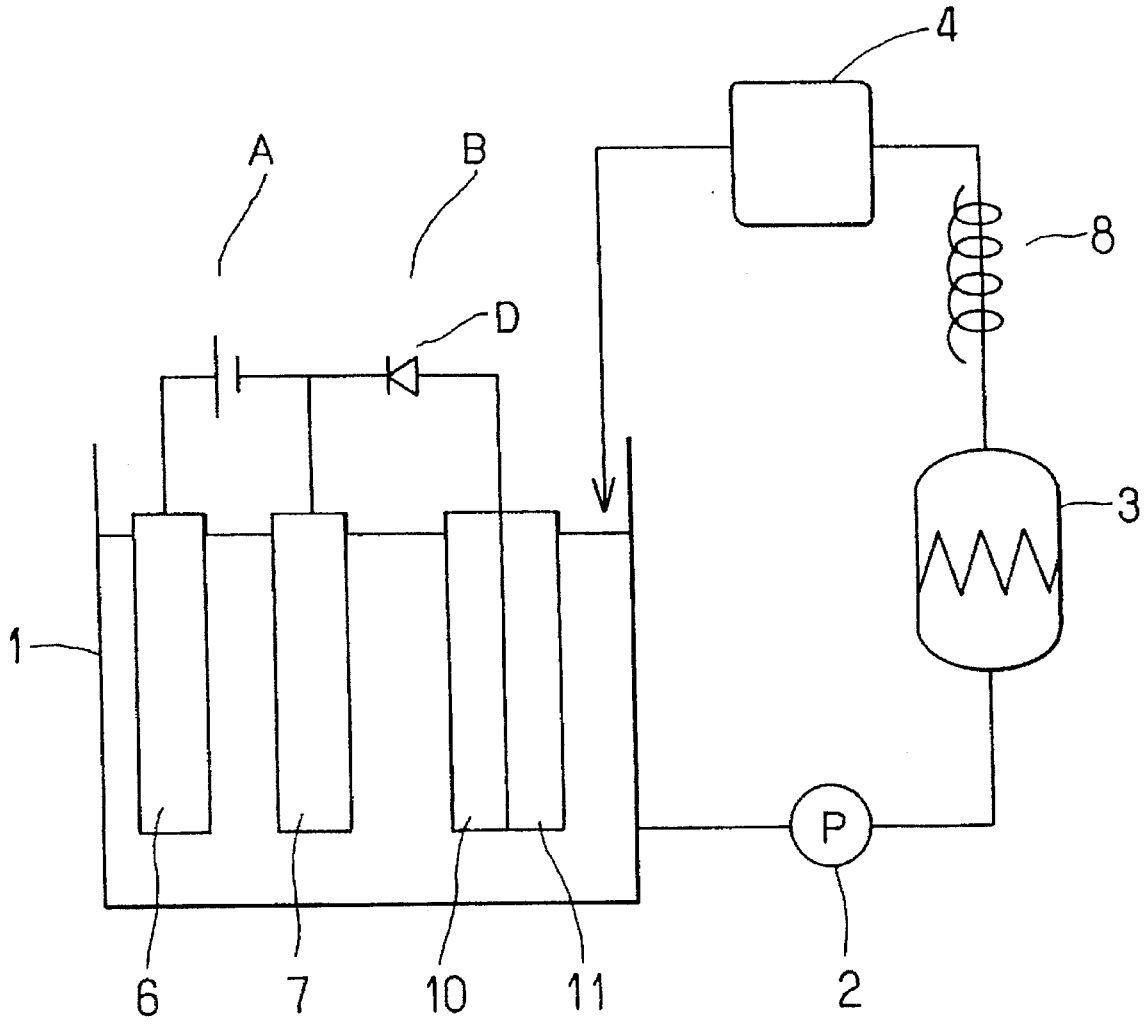
FIG. 2 is a schematic drawing of an electrolytic treatment system for phosphate chemical treatment.
Figure 3:
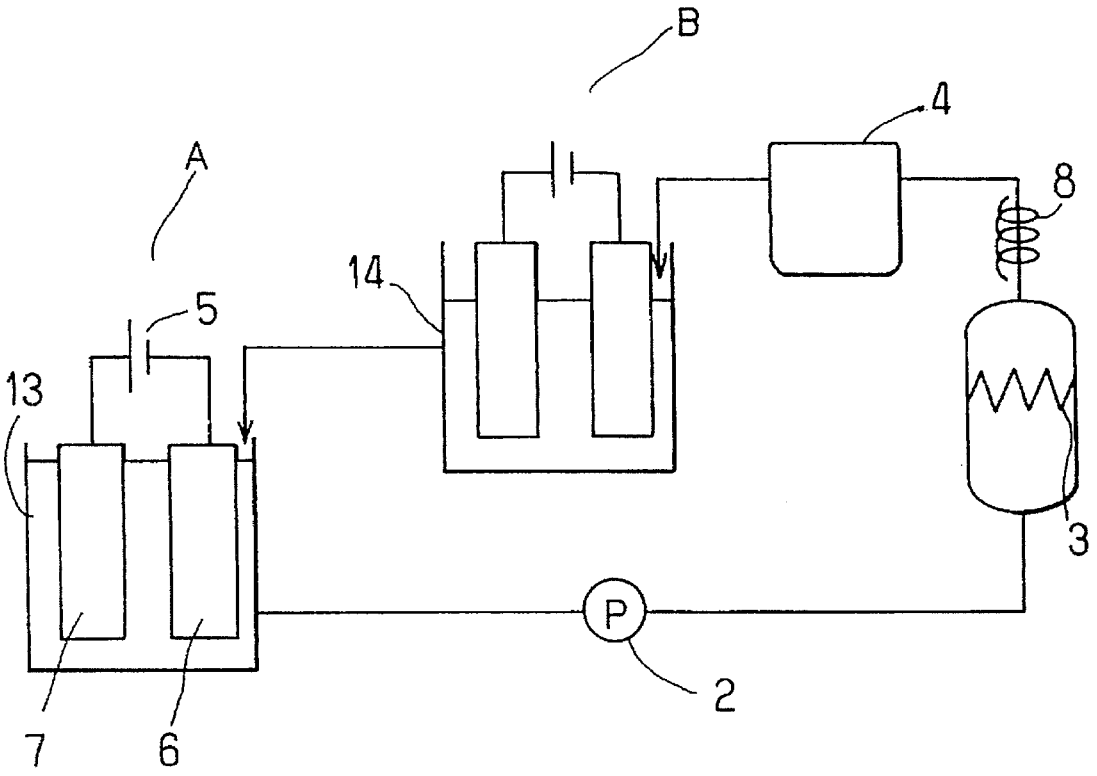
FIG. 3 is a schematic drawing of an electrolytic treatment system for phosphate chemical treatment.
Figure 4:
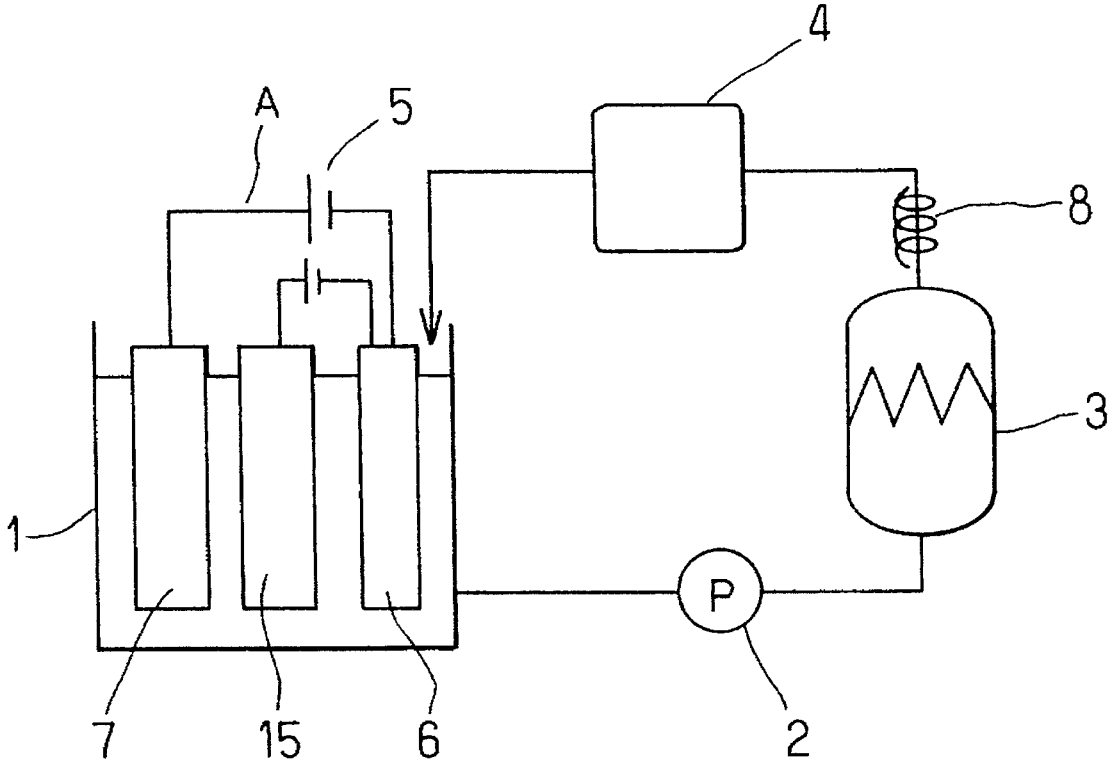
FIG. 4 is a schematic drawing of an electrolytic treatment system for phosphate chemical treatment.
Figure 5A:
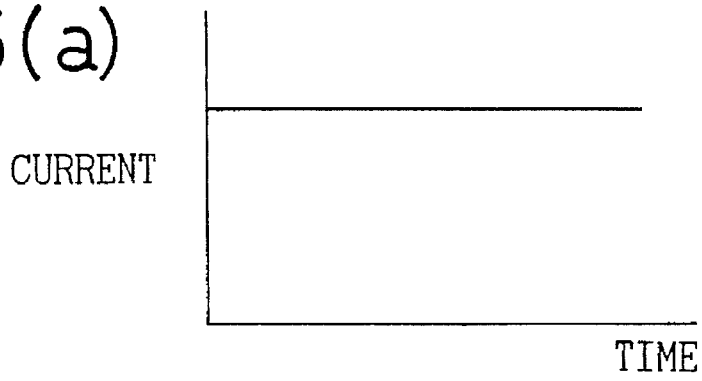
FIG. 5 (*a*), (*b*), (*c*) and (*d*) are characteristic graphs showing the states of application of electric current and voltage.
Figure 5B:
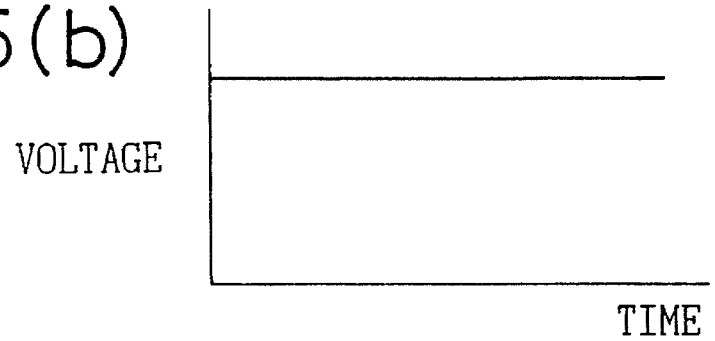
Figure 5C:
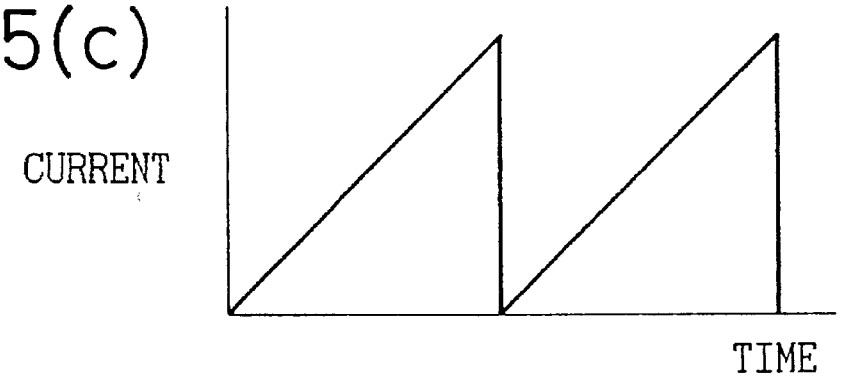
Figure 5D:
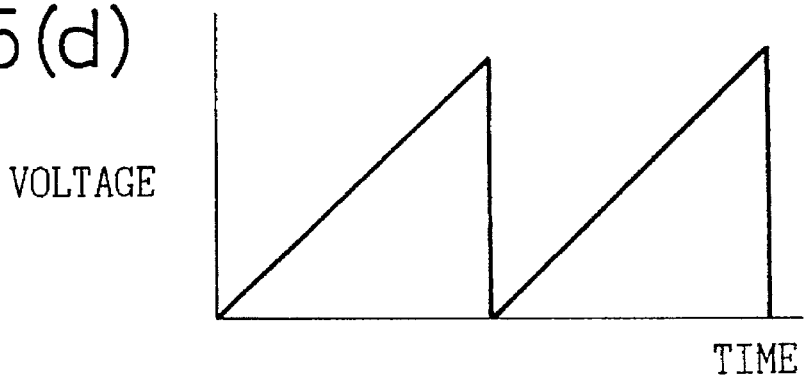
Figure 25:
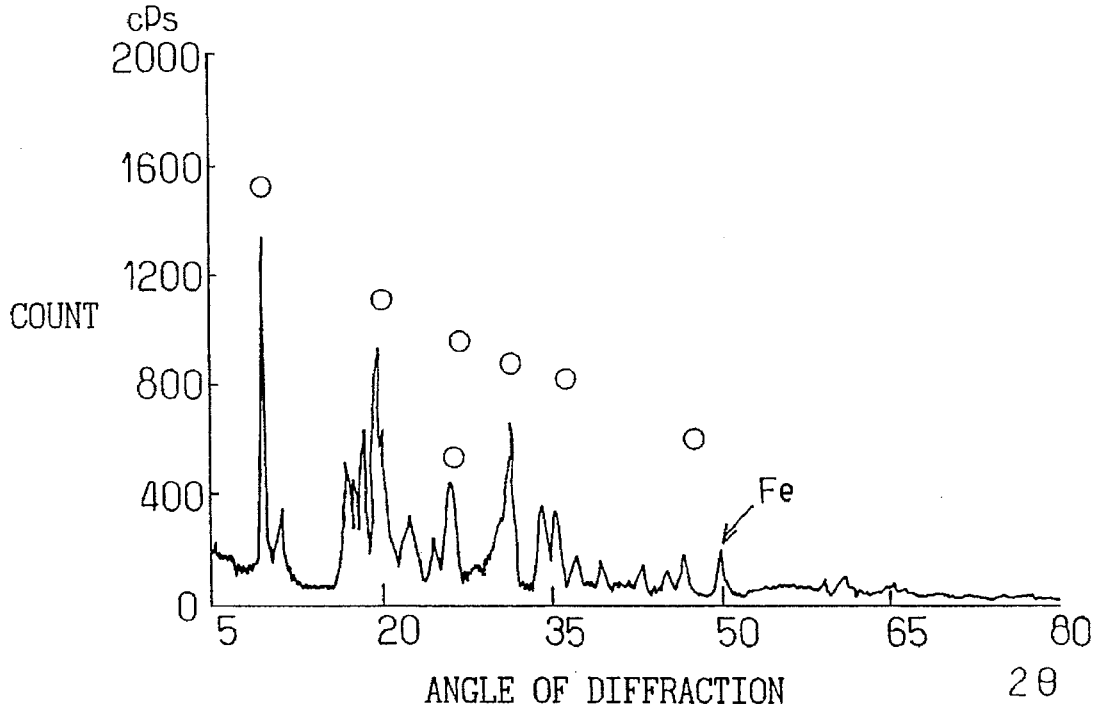
FIG. 25 is an X-ray diffraction chart for a phosphate film obtained by the method in Example 8.
Figure 26:
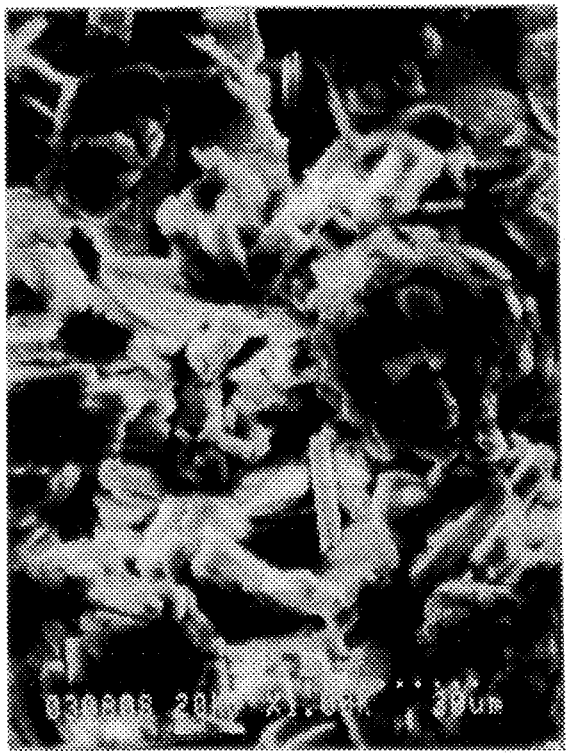
FIG. 26 is an SEM photograph of the crystalline structure of a phosphate film obtained by the method in Example 9.
Figure 28:
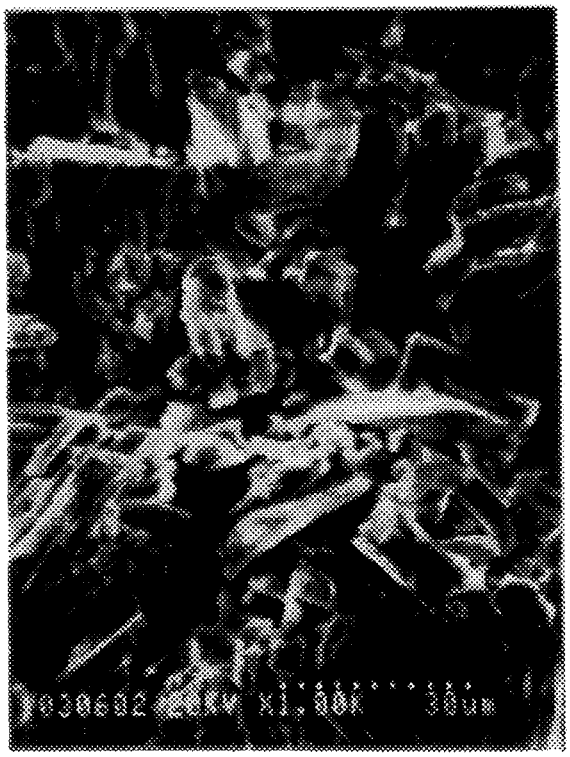
FIG. 28 is an SEM photograph of the crystalline structure of a phosphate film obtained by the method in Example 10.
Figure 27:
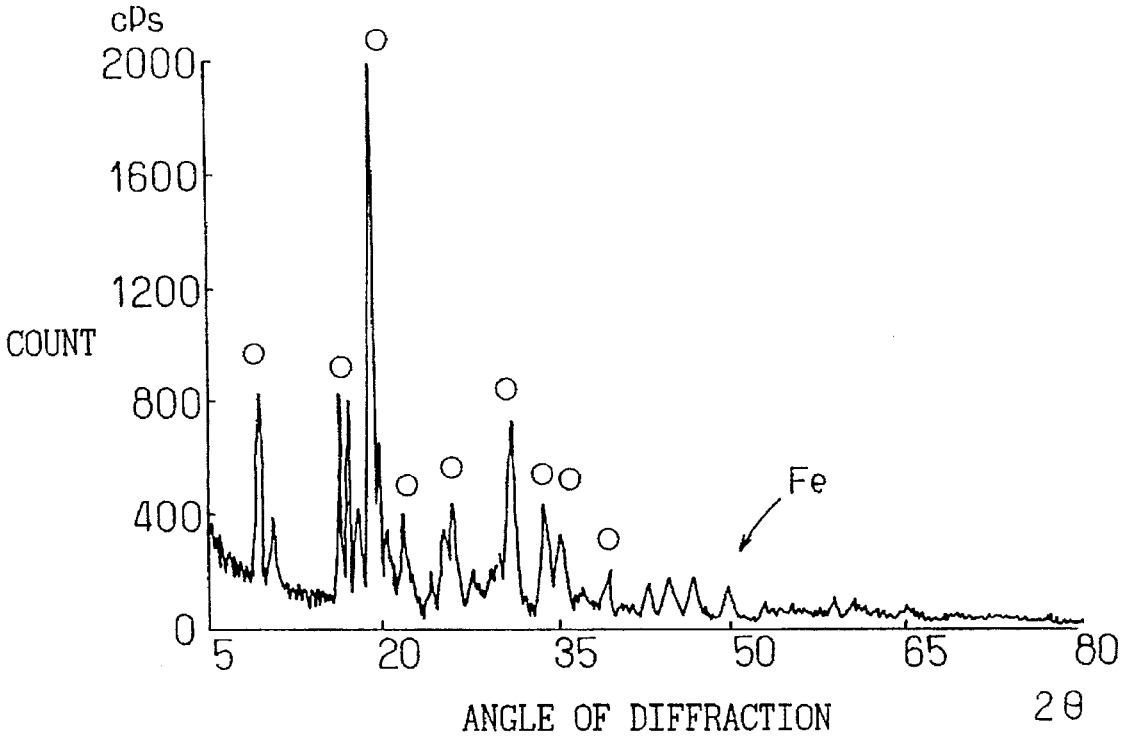
FIG. 27 is an X-ray diffraction chart for a phosphate film obtained by the method in Example 9.
Figure 29:
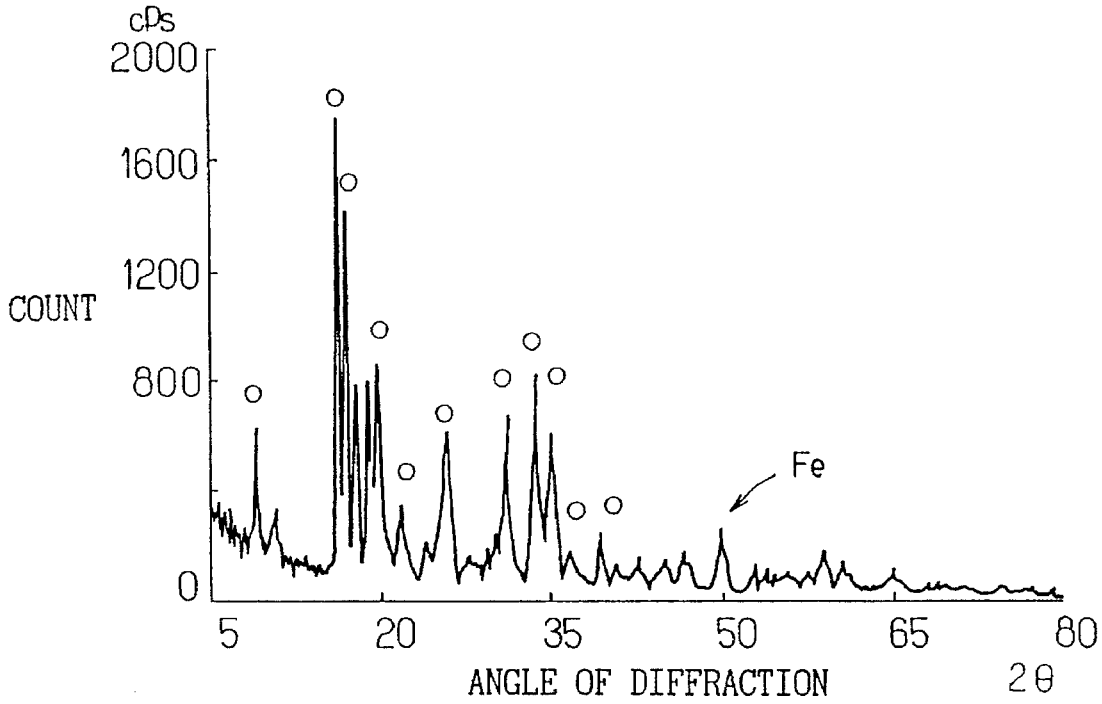
FIG. 29 is an X-ray diffraction chart for a phosphate film obtained by the method in Example 10.

| | Sample | Example 7 | Example 8 | Example 9 | Example 10 | Example 11 | Example 12 | Example 13 |
|---|---|---|---|---|---|---|---|---|
| | Material to be treated | Steel parts | Steel | Steel | Steel | Magnetic material (ILSS) | Magnetic material (ILSS) | Alternator stator (steel parts) |
| Step 1 Anodizing | Opposite electrode | Iron | Iron | Iron/nickel | Iron | Iron | Iron | Iron |
| | Anode electrolysis | Yes | Yes | Yes | Yes | Yes | Yes | Yes |
| | Electrolytic treatment system | FIG. 3 | FIG. 1 | FIG. 1 | FIG. 1 | FIG. 1 | FIG. 1 | FIG. 1 |
| | Current/voltage application method*2 | A | A | A | A | A | A | A |
| | Treatment temperature °C. | 27° C. | 27 | 24.5 | 27.5 | 26–28 | 25–28 | 25–30 |
| | Transparency (cm) | 30 cm + | 30 cm + | 30 cm + | 30 cm + | 30 cm + | 30 cm + | 30 cm + |
| Step 2 Cathodizing | Opposite electrode*–3 | — | Zinc (main) Iron (sec) | Zinc (main) Iron (sec) Nickel (sec) | Zinc (main) | Zinc/iron | Iron | Zinc/iron |
| | Cathode electrolysis | — | Yes | Yes | Yes | Yes | Yes | Yes |
| | Electrolytic treatment system | — | FIG. 2 | FIG. 2 | FIG. 2 | FIG. 4 | FIG. 1 | FIG. 4 |
| | Current/voltage application method*–2 | 2 — | C | C | C | C | B | C |
| | Treatment temperature °C. | — | 27° C. | 24.5 | 27.5 | 26–28 | 25–28 | 25–30 |
| | Transparency (cm) | | 30 cm + | 30 cm + | 30 cm + | 30 cm + | 30 cm + | 30 cm + |
| | SEM photograph | — | FIG. 24 | FIG. 26 | FIG. 28 | — | — | — |
| | X-ray diffraction chart | — | FIG. 25 | FIG. 27 | FIG. 29 | — | — | — |

*–2 As shown in FIG. 5
*–3 (main) → Main electrolysis system and (sec) → Secondary electrolysis system in FIG. 2

EXAMPLE 1

A steel material (SPCC) was used as the material to be treated. The phosphate chemical treatment began with non-electrolytic treatment for 2 minutes as the first step.

The phosphate chemical treatment bath used contained 3.0 g/l of $Zn^{2+}$, 8 g/l of $H_3PO_4$, 32 g/l of $NO_3^-$, 0.8 g/l of $Ni^{2+}$ and 0.1 g/l of $F^-$. The PH, ORP and temperature of the treatment bath were 3.20, 400–500 mV and 30° C., respectively, and the total acidity, free acidity and accelerator concentration were 16 pt, 0–0.12 pt and 6 pt, respectively. Also, the transparency of the treatment bath was 30 cm or greater, and the chemical treatment bath contained no sludge.

Next, electrolytic treatment was carried out with the material to be treated as the cathode, and a zinc plate as the anode. The phosphate chemical treatment bath used contained 3.0 g/l of $Zn^{2+}$, 16 g/l of $H_3PO_4$, 17 g/l of $NO_3^-$, 2.4 g/l of $Ni^{2+}$, 0.1 g/l of $F^-$ and 4.0 g/l of $Mn^{2+}$. The PH, ORP and temperature of the treatment bath were 3.20, 400–500 mV and 28° C., respectively, and the total acidity, free acidity and accelerator concentration were 16 pt, 0–0.01 pt and 6 pt, respectively. Also, the transparency of the treatment bath was 30 cm or greater.

The electrolytic treatment was carried out under conditions of a voltage of 0.5–1.5 V, a current of 0.2 A/dm$^2$, and a time of 40 minutes. The method of electrolysis (electrolysis treatment system and method of application of current and voltage) is shown in Table 2. The methods of electrolysis of the following Examples are also shown in Tables 2 and 3.

As a result of this treatment a phosphate chemical film was obtained with a film thickness 27 μm and a dielectric breakdown voltage of 250 V or greater, based on JIS-K6911. The film thickness was measured using an electromagnetic film thickness meter Model LE-300, product of Ketto Kagaku. The film thicknesses of the following steel materials were all measured by the same method as in Example 1. The SEM photograph and fluorescent X-ray analysis chart for the obtained phosphate chemical film are shown in FIGS. 6 and 7, respectively. In addition, the X-ray diffraction chart is shown in FIG. 8. In FIG. 8, the symbol o indicates the peaks for $Zn_3(PO_4)_2 \cdot 4H_2O$ and $Zn_3(PO_4)$.

The film obtained in Example 1 may be described as a thick-film containing nickel, manganese and zinc, with an excellent withstand voltage.

EXAMPLE 2

An aluminum plate (Al100) was used as the material to be treated, and a steel plate was used as the opposite electrode. The phosphate chemical treatment bath used was identical to the one used for electrolytic treatment in Example 1, containing 3.0 g/l of $Zn^{2+}$, 16 g/l of $H_3PO_4$, 17 g/l of $NO_3^-$, 2.4 g/l of $Ni^{2+}$, 0.1 g/l of $F^-$ and 4.0 g/l of $Mn^{2+}$. The PH, ORP and temperature of the treatment bath were 3.00–3.40, 560–570 mV and 25°–30° C., respectively, and the total acidity, free acidity and accelerator concentration were 18 pt, 0.1 pt and 6 pt, respectively. Also, the transparency of the treatment bath was 30 cm or greater, and the treatment bath contained no sludge.

The electrolytic treatment was carried out first with the aluminum plate to be treated as the anode and the steel plate as the cathode, at a voltage of 1–3 V, a current of 0.3–0.6 A/dm$^2$ for 0.5–1 minutes, and then using the same treatment bath, with the aluminum plate to be treated as the cathode and the steel plate as the anode, at a voltage of 1–3 V, a current of 0.3–0.6 A/dm$^2$ for 5 minutes.

As a result of this treatment, a phosphate film was formed on the surface of the aluminum plate with a coating weight of 6.12 g/dm$^2$.

The SEM photograph and fluorescent X-ray analysis chart for the obtained phosphate chemical film are shown in FIGS. 9 and 10, respectively. In addition, the X-ray diffraction chart for the coating is shown in FIG. 11. In FIG. 11, as in FIG. 8, the symbol o indicates the peaks for $Zn_3(PO_4)_2 \cdot 4H_2O$ and $Zn_3(PO_4)$, and the symbol Δ indicates the peaks for aluminum.

The coating obtained in Example 2 may be described as a phosphate chemical thick film containing manganese, nickel and zinc, with an excellent withstand voltage.

EXAMPLE 3

A stainless steel plate (SUS304) was used as the material to be treated, and a steel plate was used as the opposite electrode. The phosphate chemical treatment bath used was the same as in Example 2, containing 3.0 g/l of $Zn^{2+}$, 16 g/l of $H_3PO_4$, 17 g/l of $NO_3^-$, 2.4 g/l of $Ni^{2+}$, 0.1 g/l of $F^-$ and 4.0 g/l of $Mn^{2+}$. The PH, ORP and temperature of the treatment bath were 3.00–3.40, 560–570 mV and 25°–30° C., respectively, and the total acidity, free acidity and accelerator concentration were 18 pt, 0.1 pt and 6 pt, respectively. Also, the transparency of the treatment bath was 30 cm or greater, and the treatment bath contained no sludge.

The electrolytic treatment was carried out first with the stainless steel plate to be treated as the anode and the steel plate as the cathode, at a voltage of 1–3 V, a current of 0.3–0.6 A/dm$^2$ for 1 minute, and then using the same treatment bath, with the stainless steel plate to be treated as the cathode, at a voltage of 1–3 V, a current of 0.3–0.6 A/dm$^2$ for 10 minutes.

As a result of this treatment, a phosphate chemical film was formed on the surface of the stainless steel plate with a coating weight 13.27 g/dm$^2$.

The SEM photograph and fluorescent X-ray analysis chart for the obtained phosphate chemical coating are shown in FIGS. 12 and 13, respectively. In addition, the X-ray diffraction chart for the film is shown in FIG. 14. In FIG. 14, as in FIG. 8, the symbol o indicates the peaks for $Zn_3(PO_4)_2 \cdot 4H_2O$ and $Zn_3(PO_4)$.

The film obtained in Example 3 was a phosphate chemical film containing zinc.

EXAMPLE 4

An oxygen-free copper plate (C1020) was used as the material to be treated, and a steel plate was used as the opposite electrode. The phosphate chemical treatment bath used was the same as in Example 2, containing 3.0 g/l of $Zn^{2+}$, 16 g/l of $H_3PO_4$, 17 g/l of $NO_3^-$, 2.4 g/l of $Ni^{2+}$, 0.1 g/l of $F^-$ and 4.0 g/l of $Mn^{2+}$. The PH, ORP and temperature of the treatment bath were 3.00–3.40, 560–570 mV and 25°–30° C., respectively, and the total acidity, free acidity and accelerator concentration were 18 pt, 0.1 pt and 6 pt, respectively. Also, the transparency of the treatment bath was 30 cm or greater, and the treatment bath contained no sludge.

The electrolytic treatment was carried out first with the copper plate to be treated as the anode, at a voltage of 1–3 V, a current of 0.3–0.6 A/dm$^2$ for 30 seconds, and then using the same treatment bath, with the copper plate to be treated as the cathode, at a voltage of 1–3 V, a current of 0.3–0.6 A/dm$^2$ for 10 minutes.

As a result of this treatment, a phosphate chemical film was obtained on the copper plate with a coating weight 6.67 g/m$^2$.

The SEM photograph and fluorescent X-ray analysis chart for the obtained phosphate chemical coating are shown in FIGS. 15 and 16, respectively. In addition, the X-ray diffraction chart for the coating is shown in FIG. 17. In FIG. 17, as in FIG. 8, the symbol o indicates the peaks for $Zn_3(PO_4)_2 \cdot 4H_2O$ and $Zn_3(PO_4)$.

The film obtained in Example 4 may be described as a phosphate chemical film containing manganese and zinc.

EXAMPLE 5

A steel plate (SPCC) was used as the material to be treated, and a steel plate was used as the opposite electrode. The phosphate chemical treatment bath used contained 4.0 g/l of $Zn^{2+}$, 12 g/l of $H_3PO_4$, 40 g/l of $NO_3^-$, 6 g/l of $Ni^{2+}$, 0.2 g/l of $F^-$ and 5 g/l of $Mn^{2+}$. The PH, ORP and temperature of the treatment bath were 2.70, 300–400 mV and 22° C., respectively, and the total acidity and accelerator concentration were 15.8 pt and 1.6 pt, respectively. Also, the transparency of the treatment bath was 30 cm or greater, and the treatment bath contained no sludge.

The electrolytic treatment was carried out first with the steel plate to be treated as the anode, at a voltage of 2.5–3.5 V and a current of 0.5–1.0 A/dm$^2$ applied for 30 seconds, after which the treatment was repeated 12 times cutting off the current for 10 seconds between each time, for a total treatment time of 8 minutes. No cathodizing of the material to be treated was carried out thereafter.

As a result of this treatment, a dense phosphate chemical coating with a film thickness of 2–3 μm was obtained. The SEM photograph and X-ray diffraction chart for the obtained phosphate chemical coating are shown in FIGS. 18 and 19, respectively.

The film obtained in Example 5 was a dense phosphate film.

EXAMPLE 6

A steel plate (SPCC) was used as the material to be treated, and the same type of steel plate was used as the opposite electrode. The phosphate chemical treatment bath used was the same as in Example 5, containing 4.0 g/l of $Zn^{2+}$, 12 g/l of $H_3PO_4$, 40 g/l of $NO_3^-$, 6 g/l of $Ni^{2+}$, 0.2 g/l of $F^-$ and 5 g/l of $Mn^{2+}$. The PH, ORP and temperature of the treatment bath were 2.70, 300–400 mV and 23° C., respectively, and the total acidity and accelerator concentration were 16 pt and 1.6 pt, respectively. Also, the transparency of the treatment bath was 30 cm or greater, and the treatment bath contained no sludge.

The electrolytic treatment was carried out first with the steel plate to be treated as the anode, at a voltage of 1.5–2.5 V and a current of 0.5 A/dm$^2$ applied for 30 seconds, after which the treatment was repeated 12 times cutting off the current for 10 seconds between each time, for a total treatment time of 8 minutes. Next, using the same treatment bath with the material to be treated as the cathode, a voltage of 1.5–2.5 V and a current of 0.5 A/dm$^2$ were applied for 30 seconds, after which the treatment was repeated 12 times cutting off the current for 10 seconds between each time, for a total treatment time of 8 minutes.

As a result of this treatment was obtained a phosphate chemical film with a film thickness of 7 μm and a dielectric breakdown voltage of 250 V or greater, based on JISK6911.

The SEM photograph and X-ray diffraction chart for the obtained phosphate chemical coating are shown in FIGS. 20 and 21, respectively.

The film obtained in Example 6 was an insulating phosphate chemical coating.

Comparison

An example wherein electrolysis treatment was not effected is provided for comparison.

A steel plate (SPCC) was used as the material to be treated. The phosphate chemical treatment bath used contained 3.2 g/l of $Zn^{2+}$, 8 g/l of $H_3PO_4$, 32 g/l of $NO_3^-$, 0.8 g/l of $Ni^{2+}$ and 0.2 g/l of $F^-$. The PH, ORP and temperature of the treatment bath were 3.20, 510–540 mV and 28° C., respectively, and the total acidity, free acidity and accelerator concentration were 16 pt, 0–0.1 pt and 6 pt, respectively. Also, the transparency of the treatment bath was 30 cm or greater, and the treatment bath contained no sludge.

The material to be treated was immersed in the treatment bath for 8 minutes.

As a result of this treatment was obtained a phosphate chemical coating with a film thickness of 1 μm and a dielectric breakdown voltage of 50 V, based on JISK6911.

An SEM photograph of the obtained phosphate chemical coating is shown in FIG. 22.

The phosphate chemical coating obtained in the Comparison was obtained in a conventional manner using a non-electrolytic method, and it is not expected that the thickness of the film would be increased or that the withstand voltage would be improved even if the immersion time were extended.

EXAMPLE 7

Figure 23:
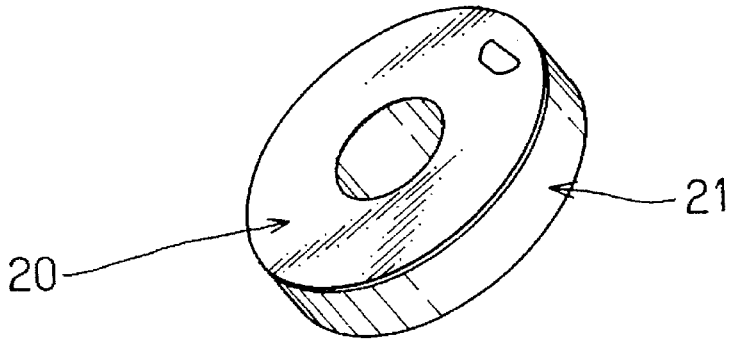
FIG. 23 is a rough drawing of a part used in Example 7.

As shown in FIG. 23, steel parts usually used as a clutch for an automobile air conditioner compressor were used as the material to be treated, and a steel plate was used as the opposite electrode.

The steel part had simple hollow shape with a diameter of 96 mm and a thickness of 27 mm.

The phosphate chemical treatment bath used contained 4.2 g/l of $Zn^{2+}$, 8 g/l of $H_3PO_4$, 24.1 g/l of $NO_3^-$, 2.6 g/l of $Ni^{2+}$ and 0.1 g/l of $F^-$. The PH, ORP and temperature of the treatment bath were 2.93, 580–590 mV and 27° C., respectively, and the total acidity and accelerator concentration were 20 pt and 6.0 pt, respectively. Also, the transparency of the treatment bath was 30 cm or greater, and it contained no sludge.

The electrolytic treatment was carried out following the method shown in FIG. 3, with the parts to be treated as the anode and the steel plate as the cathode in the main electrolysis system, at a voltage of 0.3–1.0 V and at a current of 0.01 A–0.14 A/treated material according to the method in FIG. 5 (*a*) for 2 minutes.

In the secondary electrolysis system B, when the ORP of the treatment bath fell to about 560 mV, current scanning electrolysis was performed according to the method in FIG. 5 (*c*) to remove the $Fe^{2+}$ which had dissolved in the treatment bath and raise the ORP. Then, Cation electrodeposit painting (POWER TOP U56, product of Nihon Paint) was performed, followed by baking at 190° C. for about 25 minutes. The painted material was allowed to stand for 24 hours or more, after which the flat section 20 and edge side 21 of the part were sliced to the base using a cutter knife, and then the part was immersed in 5% saline at 55° C. for 240 hours for a salt immersion test. After 240 hours had passed the material was washed with water and held in the air for about 2 hours, after which adhesive tape was pasted over the paint film surface which had been sliced with the cutter knife, and then peeled off forcefully. The width of the paint film which was peeled off by the adhesive tape was measured and found to be 5 mm or less for both the flat section 20 and the edge side 21.

A similar bath (but with an ORP value of 560 mV or less) was used for non-electrolytic treatment, and when the part was immersed for 2 minutes for chemical treatment and painted in the same manner and then subjected to the same test for evaluation of the paint film, the peeled films produced were found to be 5 mm or less for the flat section 20, but about 8–12 mm for the edge side 21.

From the above evaluation, it may be said that the method according to the present invention provides a favorable corrosion resistivity for the edge side 21 after painting. The edge side 21 is the section which displays the greatest degree of deformity when this part is formed by prossing and thus its chemical treatment has been troublesome by the non-electrolytic method according to the prior art. Therefore, by non-electrolytic chemical treatment the corrosion resistivity of the paint is inferior, but by carrying out anode electrolysis as in Example 7, the dissolution of materials and their chemical treatment are made possible even for sections with materials whose dissolution has been troublesome according to the prior art, and thus the corrosion resistivity of the paint is improved.

In addition, the method in FIG. 5 (*c*) was carried out in electrolytic chemical treatment, using the same type of part in the same type of treatment bath, in the same electrolytic treatment system, as above, for a 2 minute electrolytic treatment by a method in which the current was raised from 0 A→0.01 A over a 30 second period, maintained for 30 seconds, and then lowered from 0.01 A→0 A over a 60 second period. The part was then painted, and a salt immersion test such as described above was conducted. As a result, the flat section 20 and the edge side 21 both had a tape peeled width of 5 mm or less, and the corrosion resistivity of the paint was superior to the product of non-electrolytic treatment.

In Example 7 above, a secondary electrolysis system was used for dissolution of the material, but this is sometimes unnecessary depending on the conditions (current, voltage, etc.) used for the anodizing.

EXAMPLE 8

A steel plate (SPCC) was used as the material to be treated, and for the opposite electrodes were used iron for the anodizing, and for the cathodizing iron in the secondary electrolysis system and zinc in the main electrolysis system.

The phosphate chemical treatment bath used contained 7.6 g/l of $Zn^{2+}$, 28.3 g/l of $H_3PO_4$, 27.1 g/l of $NO_3^-$, 1.44 g/l of $Ni^{2+}$ and 0.1 g/l of $F^-$. The PH, ORP and temperature of the treatment bath were 3.03, 573 mV and 27° C., respectively, and the total acidity, free acidity and accelerator concentration were 38.4 pt, 1.6 pt and 5.0 pt, respectively. Also, the transparency of the treatment bath was 30 cm or greater, and the treatment bath contained no sludge.

The electrolytic treatment was carried out first with the material to be treated as the anode and iron as the cathode, by constant current electrolysis as in FIG. 5 (*a*) in the system shown in FIG. 1, for 1 minute at a current of 0.05 A/dm$^2$ (voltage: 0.3 V). Next, using the same treatment bath, a main electrolysis system was formed using the material to be treated as the cathode and zinc as the anode.

In addition, wiring was connected between the material to be treated and the iron electrode, but the wiring was arranged so as to allow the current to flow only in the direction from the iron electrode to the material to be treated. The path comprising the material to be treated and the iron became the secondary electrolysis system.

The cathodizing in the main electrolysis system A in FIG. 2 was carried out by current scanning electrolysis, slowly raising the current applied between two electrodes of the main electrolysis system A from 0 A/dm$^2$→1.5 A/dm$^2$ over a period of 5 minutes. The maximum applied voltage at this time was 4.5 V. The same procedure was then repeated for 6 cycles, for a total of 30 minutes of cathodizing.

As a result of this treatment, a phosphate chemical film with a film thickness of 15–30 μm was formed on the surface of the steel. (The film thickness was measured using an electromagnetic film thickness meter Model LE-300, product of Ketto Kagaku). The insulation resistance of this film was measured using a superinsulation meter MODEL SM-8210, product of Toa Denpa KK. The measurement was performed by lightly contacting the cylindrical probes (positive electrode, negative electrode) of the superinsulation meter onto the surface. As a result, the flat section and edge section of the steel plate both exhibited an insulation resistance of 500 V DC or greater.

The SEM photograph and X-ray diffraction chart for the obtained phosphate chemical film are shown in FIGS. 24 and 25, respectively. In FIG. 25, as in FIG. 8, the symbol o indicates the peaks for $Zn_3(PO_4)_2 \cdot 4H_2O$ and $Zn_3(PO_4)$.

EXAMPLE 9

A steel plate (SPCC) was used as the material to be treated, and for the opposite electrodes iron was used for the anodizing, and for the cathodizing zinc was used in the main electrolysis system A and iron and nickel were used in the secondary electrolysis system B.

The phosphate chemical treatment bath used contained 7.0 g/l of $Zn^{2+}$, 45.0 g/l of $H_3PO_4$, 26.0 g/l of $NO_3^-$, 1.4 g/l of $Ni^{2+}$ and 0.1 g/l of $F^-$. The PH, ORP and temperature of the treatment bath were 3.02, 565 mV and 24.5° C., respectively, and the total acidity, free acidity and accelerator concentration were 51.8 pt, 2.4 pt and 5.6 pt, respectively. Also, the transparency of the treatment bath was 30 cm or greater, and the treatment bath contained no sludge.

The electrolytic treatment was carried out first with the material to be treated as the anode and iron as the cathode, by constant current electrolysis as in FIG. 5 (*a*) in the apparatus shown in FIG. 1, for 1 minute at a current of 0.05 A/dm$^2$ (voltage: 0.3 V).

Next, using the same treatment bath, the apparatus in FIG. 2 was used. That is, a main electrolysis system A was formed using the material to be treated 7 as the cathode and zinc as the anode. In addition, wiring was connected between the material to be treated 7 and the iron and nickel electrodes 10, 11, but the wiring was arranged so as to allow the current to flow only in the direction from the iron and nickel electrodes to the material to be treated. The path comprising the material to be treated 7 and the iron and nickel electrodes 10, 11 became the secondary electrolysis system B.

The cathodizing in the main electrolysis system A was carried out by current scanning electrolysis, slowly raising the current applied between the electrodes of the main electrolysis system A from 0 A/dm$^2$→2.0 A/dm$^2$ over a period of 5 minutes. The maximum applied voltage at this time was 4.9 V. The same procedure was then repeated for 6 cycles, for a total of 30 minutes of cathodizing.

As a result of this treatment, a phosphate chemical film with a film thickness of 15–30 μm was formed on the surface of the steel plate. (The film thickness was measured using an electromagnetic film thickness meter Model LE-300, product of Ketto Kagaku). The insulation resistance of this film was measured using a superinsulation meter MODEL SM-8210, product of Toa Denpa KK.

The measurement was performed by lightly contacting the probes (positive electrode, negative electrode) of the superinsulation meter onto the surface.

As a result, the flat section and edge section of the steel plate both exhibited an insulation resistance of 500 V DC or greater.

The SEM photograph and X-ray diffraction chart for the obtained phosphate chemical film are shown in FIGS. 26 and 27, respectively. In FIG. 27, as in FIG. 8, the symbol o indicates the peaks for $Zn_3(PO_4)_2 \cdot 4H_2O$ and $Zn_3(PO_4)$.

EXAMPLE 10

A steel plate (SPCC) was used as the material to be treated, and for the opposite electrodes iron was used for the anodizing, and zinc was used for the cathodizing.

Also, the iron electrode plate was disconnected from the power source and immersed in the bath. The phosphate chemical treatment bath used contained 7.0 g/l of $Zn^{2+}$, 45.0 g/l of $H_3PO_4$, 26.0 g/l of $NO_3^-$, 1.4 g/l of $Ni^{2+}$ and 0.1 g/l of $F^-$. The PH, ORP and temperature of the treatment bath were 3.02, 569 mV and 27.5° C., respectively, and the total acidity, free acidity and accelerator concentration were 51.8 pt, 2.4 pt and 5.6 pt, respectively. Also, the transparency of the treatment bath was 30 cm or greater, and the treatment bath contained no sludge.

The electrolytic treatment was carried out first with the material to be treated as the anode and iron as the cathode, by constant current electrolysis as in FIG. 5 (*a*) in the apparatus shown in FIG. 1, for 1 minute at a current of 0.05 $A/dm^2$ (voltage: 0.8 V).

Next, using the same treatment bath, an electrolysis system was formed using the material to be treated 7 as the cathode and zinc as the anode. Here, the steel plate was immersed in the bath. When a steel plate is immersed in a treatment bath, it exists as a component in the electrolytic reaction system. That is, the iron is easily dissolved from the steel plate, and the dissolved $Fe^{2+}$ adheres to the surface of the material being treated as a chemical film. As a result, the film thickness of the chemical film is much greater in comparison with Examples 8 and 9. The cathodizing in the main electrolysis system A was carried out by current scanning electrolysis, slowly raising the current applied between the electrodes of the main electrolysis system A from 0 $A/dm^2 \rightarrow 2.0$ $A/dm^2$ over a period of 5 minutes. The maximum applied voltage at this time was 5.8 V. The same procedure was then repeated for 6 cycles, for a total of 30 minutes of cathodizing.

As a result of this treatment, a phosphate chemical film with a film thickness of 50–60 μm was formed on the surface of the steel plate. (The film thickness was measured using an electromagnetic film thickness meter Model LE-300, product of Ketto Kagaku). The insulation resistance of this film was measured using a superinsulation meter MODEL SM-8210, product of Toa Denpa KK. The measurement was performed by lightly contacting the probes (positive electrode, negative electrode) of the superinsulation meter onto the surface. As a result, the flat section of the steel plate exhibited an insulation resistance of 500 V DC or greater. However, the withstand voltage of the edge section was about 250 V. Also, its adherence to the foundation of the film was also inferior with respect to the above Examples 8 and 9. From the above results it may be said that the control of the iron ion in the chemical treatment bath is necessary to form a thick-film type insulating chemical film.

The SEM photograph and X-ray diffraction chart for the obtained phosphate chemical film are shown in FIGS. 28 and 29, respectively. In FIG. 29, as in FIG. 8, the symbol o indicates the peaks for $Zn_3(PO_4)_2 \cdot 4H_2O$ and $Zn_3(PO_4)$.

EXAMPLE 11

Figure 30:
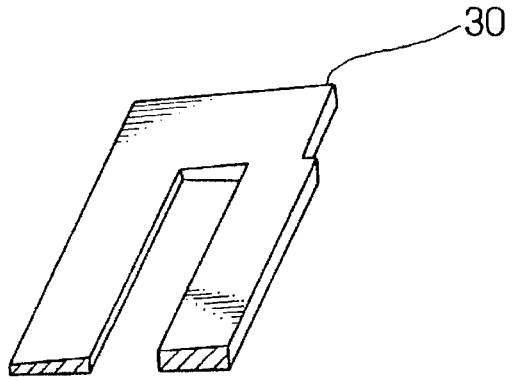
FIG. 30 is a rough drawing of a segment used in Example 11.

As the material to be treated was used a solenoid stator core segment 30, shown in FIG. 30, used in automobile fuel injection pumps, which is made of a magnetic material (1 LSS, containing 1% Si).

For the opposite electrodes iron was used for the anodizing, and iron and zinc were used for the cathodizing. The phosphate chemical treatment bath used contained 12 g/l of $Zn^{2+}$ and 1.6 g/l of $Ni^{2+}$. (In addition, $NO_3^-$, $H_3PO_4$ and $F^-$ were also used, but they were not measured). The PH, ORP and temperature of the treatment bath were 2.96–3.02, 577–581 mV and 26°–28° C., respectively, and the total acidity and accelerator concentration were 40 pt and 3.0 pt, respectively. (The free acidity was not measured). Also, the transparency of the treatment bath was 30 cm or greater, and the treatment bath contained no sludge.

The chemical treatment was carried out by a method in which 200 segments identical to the segment 30 in FIG. 30 were placed in a small acrylic resin barrel for electrolytic treatment.

A total of 4 barrels, or 800 parts, were used for the treatment. The barrels were rotated at 2 rpm, and a number of 5 m/m holes were made in the side to allow greater fluidity of the bath.

The electrolytic treatment was carried out first with the material to be treated as the anode and iron as the cathode, by constant current electrolysis as in FIG. 5 (*a*) in the connected system shown in FIG. 1.

Here, the current was 0.06 A/barrel, and the voltage was between 1.2 V and 3.5 V. The surface area per barrel corresponded to 6.2 $dm^2$. The anodizing was carried out for 5 minutes, after which the power source was cut off for 2.5 minutes.

The cathodizing was carried out with iron and zinc as the anodes and a barrel containing the material to be treated as the cathode to form an electrolysis system such as shown in FIG. 4, by the method of current scanning electrolysis shown in FIG. 5 (*c*).

Here, the current applied at the iron electrode was successively raised from 0 A (amperes)/barrel→0.06 A–0.1 A/barrel over a period of 90 seconds, while that at the zinc electrode was successively raised from 0 A/barrel→0.5–1.0 A/barrel also over a period of 90 seconds, and the same procedure was then repeated for 15 cycles.

As a result of this treatment, a chemical film with a film thickness of 3–10 μm was formed on the surface of the magnetic material, i.e., the surface of the segment 30. (The film thickness was measured using an electromagnetic film thickness meter, product of Ketto Kagaku).

The insulation resistance of this film was measured using a superinsulation meter, product of Toa Denpa KK. The method of measurement was the same as the one used in Examples 8–10. As a result, the flat section exhibited an insulation resistance of 100 V (DC) or greater.

Figure 31:
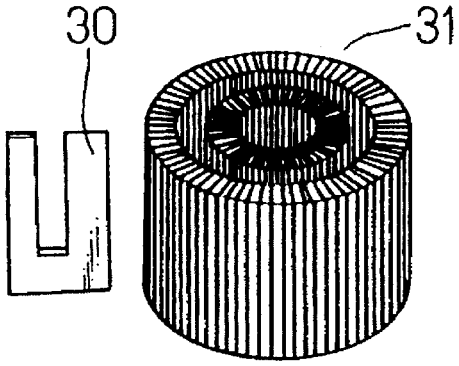
FIG. 31 is a rough drawing showing the core in Example 11.

The solenoid stator core segments 30 in FIG. 30 which were used in Example 11 were stacked to prepare a stator core 31 such as shown in FIG. 31.

Figure 32:
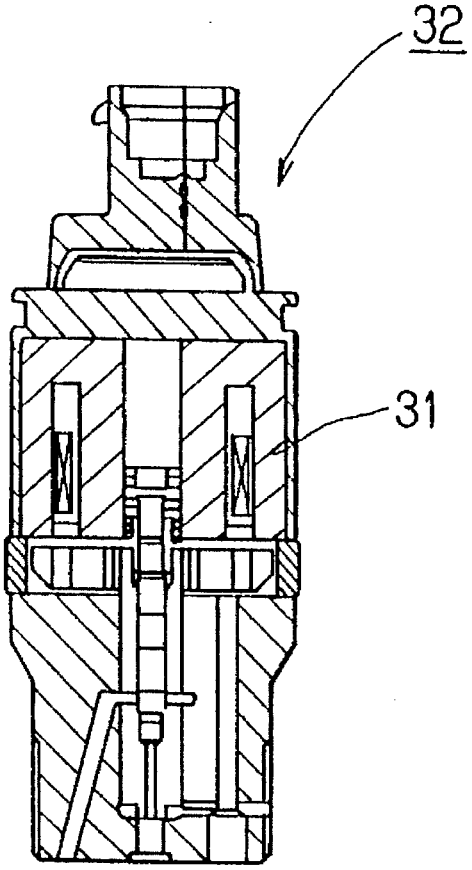
FIG. 32 is a cross-sectional view of a bulb comprising the core in Example 11.

Also, as shown in FIG. 32, the stator core 31 was coiled and set in place to produce a bulb 32 for controlling the injection amount of an automobile fuel (gas oil) injection pump.

Figure 33:
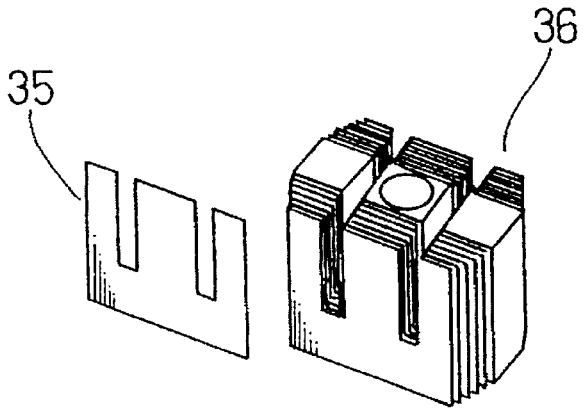
FIG. 33 is a rough drawing showing a core according to the prior art.

A conventional solenoid stator core segment 35 and a stator core 36 using it are shown in FIG. 33.

The conventional segment 35 was an F-shaped segment (Material G09) which had already undergone insulation treatment.

Forging (deformation) is not possible by the insulation treatment of magnetic materials according to the prior art, and therefore the conventional stator core 36 is in the form of a stack of punched plates. Using this stator core 36, a fuel injection pump bulb 37 was produced as shown in FIG. 34.

Figure 34:
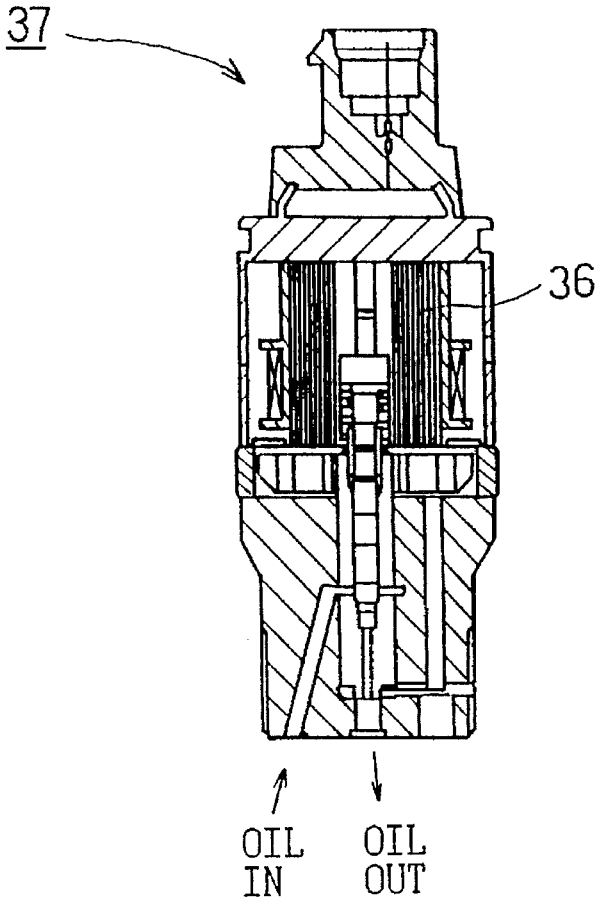
FIG. 34 is a cross-sectional view of a bulb comprising a core according to the prior art.

Here, the size (measurements) of the bulb 32 in FIG. 32 relating to Example 11 and that of the conventional bulb 37 in FIG. 34 are identical.

Figure 35:
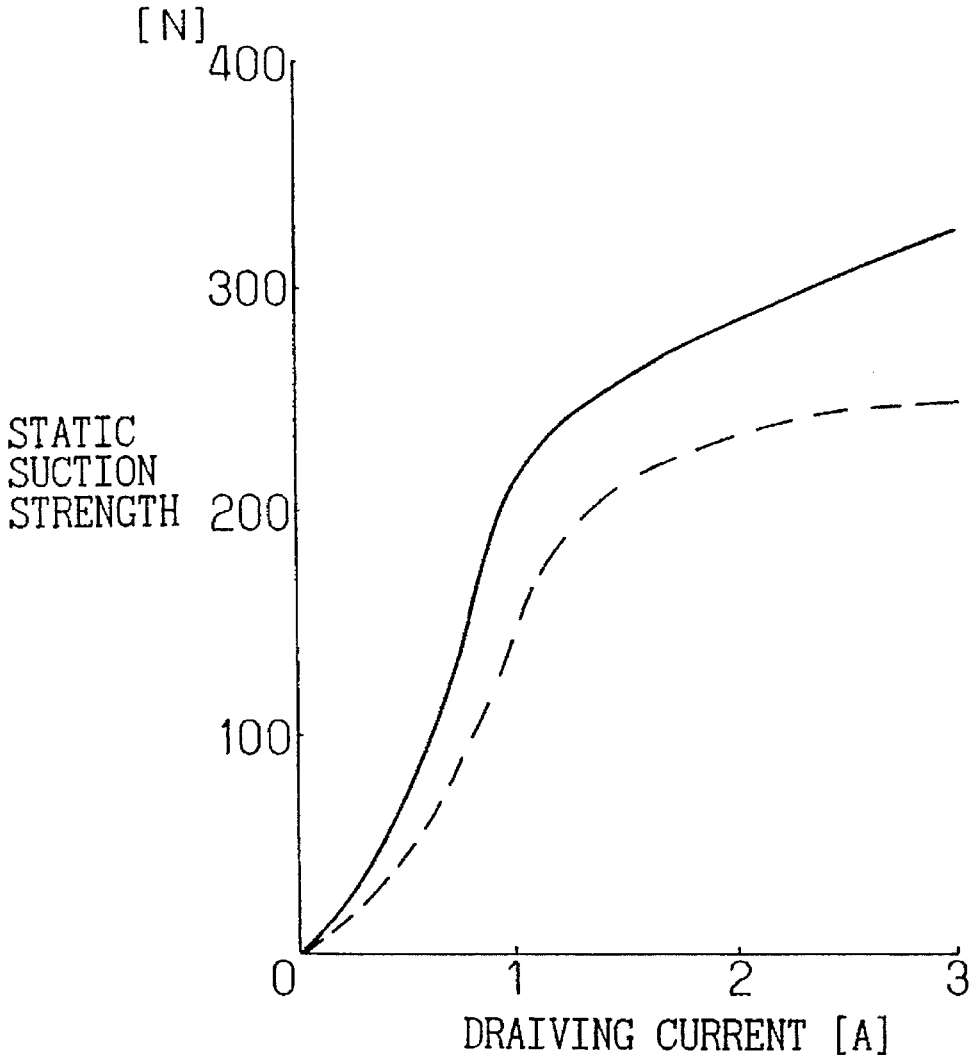
FIG. 35 is a characteristic graph showing the properties for Example 11.

A comparison of the properties of each of the bulbs 32, 34 is shown in FIG. 35.

As a result of the evaluation of the static suction strength against a driving current (A), the bulb 32 (solid curve in FIG.

35) was confirmed to have a more excellent suction (actuation) capability for a solenoid in comparison with the bulb 37 (dotted curve in FIG. 35), though their structures were identical.

EXAMPLE 12

As the material to be treated was used a magnetic material (ILSS) from the same type of solenoid core segment used in Example 11, of length 500 mm, width 28 mm and thickness 2 mm prior to forging.

Iron was used for the opposite electrodes, and anodizing was followed by cathodizing. The phosphate chemical treatment bath used contained 6 g/l of $Zn^{2+}$ and 6 g/l of $Ni^{2+}$. The treatment bath had a PH of 3.03, an ORP of 576 mV and a temperature of 25°–30° C., with a total acidity of 44 pt and an accelerator concentration of 5.2 pt. (The free acidity was not measured). Also, the transparency of the treatment bath was 30 cm or greater, and the treatment bath contained no sludge.

The electrolytic treatment was carried out first with the material to be treated as the anode and iron as the cathode, by constant current electrolysis as in FIG. 5 (*a*) in the electrolysis system shown in FIG. 1, for 1 minute. Here, the current was 0.4 A/material and the voltage was 2.4 V.

The cathodizing was carried out in the same bath with the material to be treated as the cathode and iron as the anode, by a method of current application in the same electrolysis system as the one used for the anodizing, for 3 minutes. Here, the current was 0.4 A/material and the voltage was 2.4 V. The coated material was subjected to water washing and then drying, after which it was immersed for 10 minutes in an 80° C. solution of 5% sodium stearate, to obtain a zinc stearate metal soap film on the surface thereof.

Figure 36:
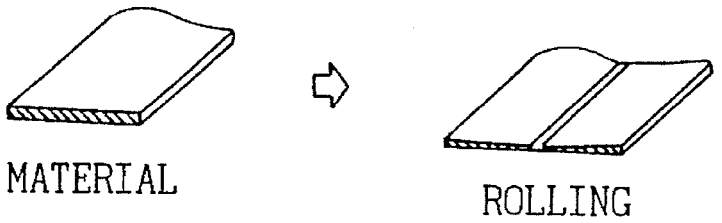
FIG. 36 is a diagram of explanation for Example 12.

This material was rolled in a direction which reduced the plate thickness at the center, as shown in FIG. 36.

The rolling was performed using a 200-ton press, applying a load of 60 tons and 70 tons each time with a 10 mm shift each time, for a total of 6 rolls, and the resulting thin-plate thickness ($t_1$) was measured.

Figure 37:
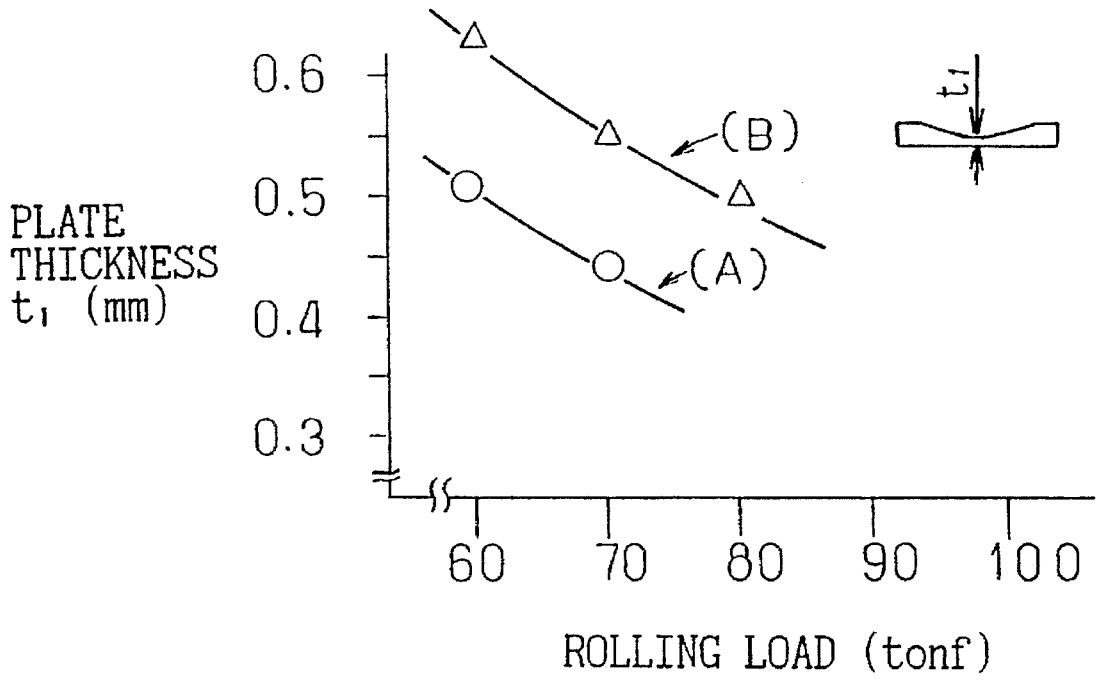
FIG. 37 is a characteristic graph showing the properties for Example 12.

The results are shown in FIG. 37.

Curve (A) in FIG. 37 shows the results for the chemical film according to the present invention. For a rolling comparison, curve (B) in FIG. 37 shows the results for a case in which no chemical film was formed, and only processed oil (D200-A, product of Sugimura Kagaku) was used.

From FIG. 37 it is clear that, for the rolling of magnetic materials, the chemical film according to the present invention is more excellent than the materials according to the prior art rolled using only processed oil.

EXAMPLE 13

Figure 38A:
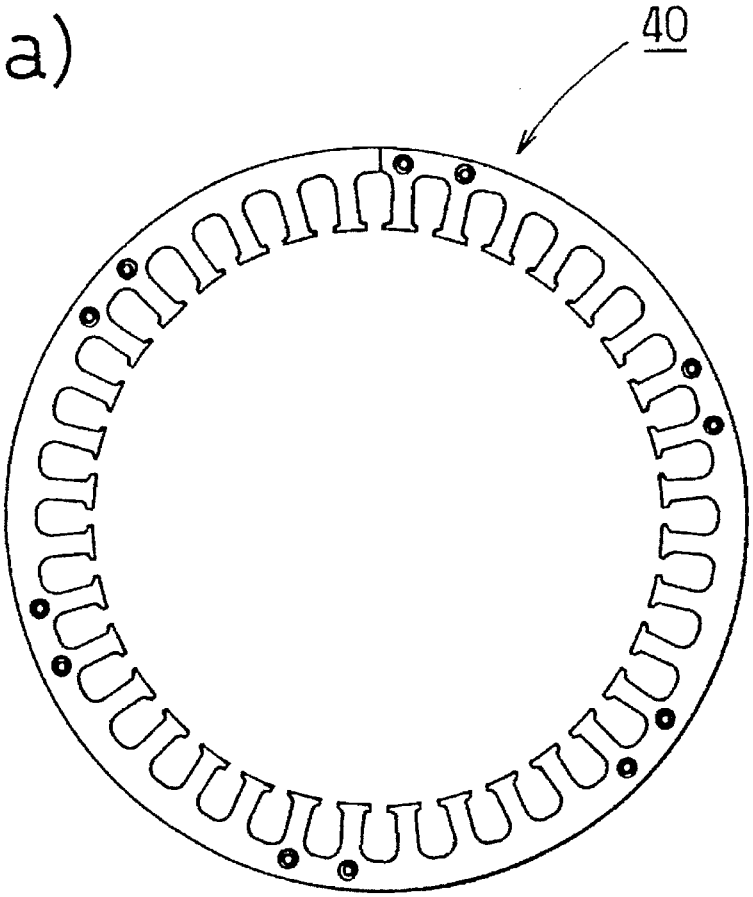
FIG. 38 (*a*) and (*b*) are frontal and side views, respectively, of the core in Example 13.
Figure 38B:
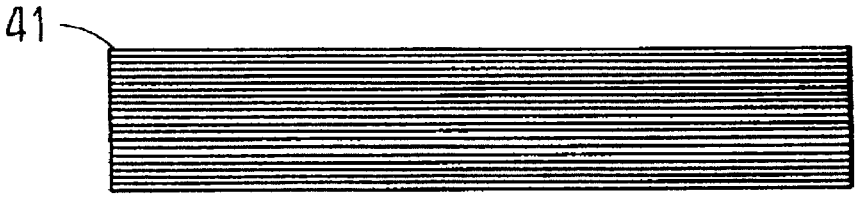

As the material to be treated was used an automobile alternator stator core 40, shown in FIGS. 38(*a*) and (*b*).

This core 40 contained multiple layers of segments 41 each with a plate thickness of 0.5 mm.

The phosphate chemical treatment bath used for treatment of the core 40 contained 5 g/l of $Zn^{2+}$, 25 g/l of $H_3PO_4^-$, 0.8 g/l of $Ni^{2+}$, 16 g/l of $NO_3^-$ and 0.1 g/l of $F^-$.

The treatment bath had a PH of 3.30, an ORP of 540–550 mV and a temperature of 28° C., with a total acidity of 35 pt, a free acidity of 0.2 pt and an accelerator concentration of 4–6 pt. Also, the transparency of the treatment bath was 30 cm or greater, and the treatment bath contained no sludge.

The electrolytic treatment was carried out first with the material to be treated as the anode and iron as the cathode, by constant current electrolysis as in FIG. 5 (*a*) in the system shown in FIG. 1, with a current of 0.4 A/material (voltage: 1.8 V), for 5 minutes. Then, using the same treatment bath, a main electrolysis system was formed using the material to be treated as the cathode and zinc and iron as the anodes.

Also, an electrolytic treatment system such as the apparatus shown in FIG. 4 was formed for cathodizing. The cathodizing was carried out by current scanning electrolysis, slowly raising the current applied between the electrodes of the zinc electrolysis system from 0 A→1.25 A/material over a period of 40 seconds. Also, the current applied between the electrodes of the iron electrolysis system was slowly raised from 0 A→0.4 A/material over a period of 40 seconds. Further, the electrolysis of the zinc and the iron was carried out simultaneously. The same procedure was then repeated for 20–30 cycles, for a total of 13–20 minutes of cathodizing.

As a result of this treatment, a phosphate chemical film with a film thickness of 20–25 μm was formed on the surface of the material. (The film thickness was measured using an electromagnetic film thickness meter Model LE-300, product of Ketto Kagaku, KK). The insulation resistance of this film was measured using a superinsulation meter MODEL SM-8219, product of Toa Denpa KK. The measurement was performed by lightly contacting the probes (positive electrode, negative electrode) of the superinsulation meter onto the surface. As a result, the flat section of the material exhibited an insulation resistance of 500 V DC or greater.

The material was then subjected to Cation electrodeposition painting using a POWER TOP U-600E, product of Nihon Paint, to form an organic film with a thickness of 40–50 μm. The baking was performed at 180° C. for 30 minutes.

In this manner an alternator stator core 40 having an insulation layer with a thickness of 50–70 μm was obtained.

Using the stator core 40 in Example 13, mechanical coiling was performed in the slot sections 44.

The coils 42 having a wire diameter of 1.4 mm were automatically placed with 12 coils per slot.

Figure 39:
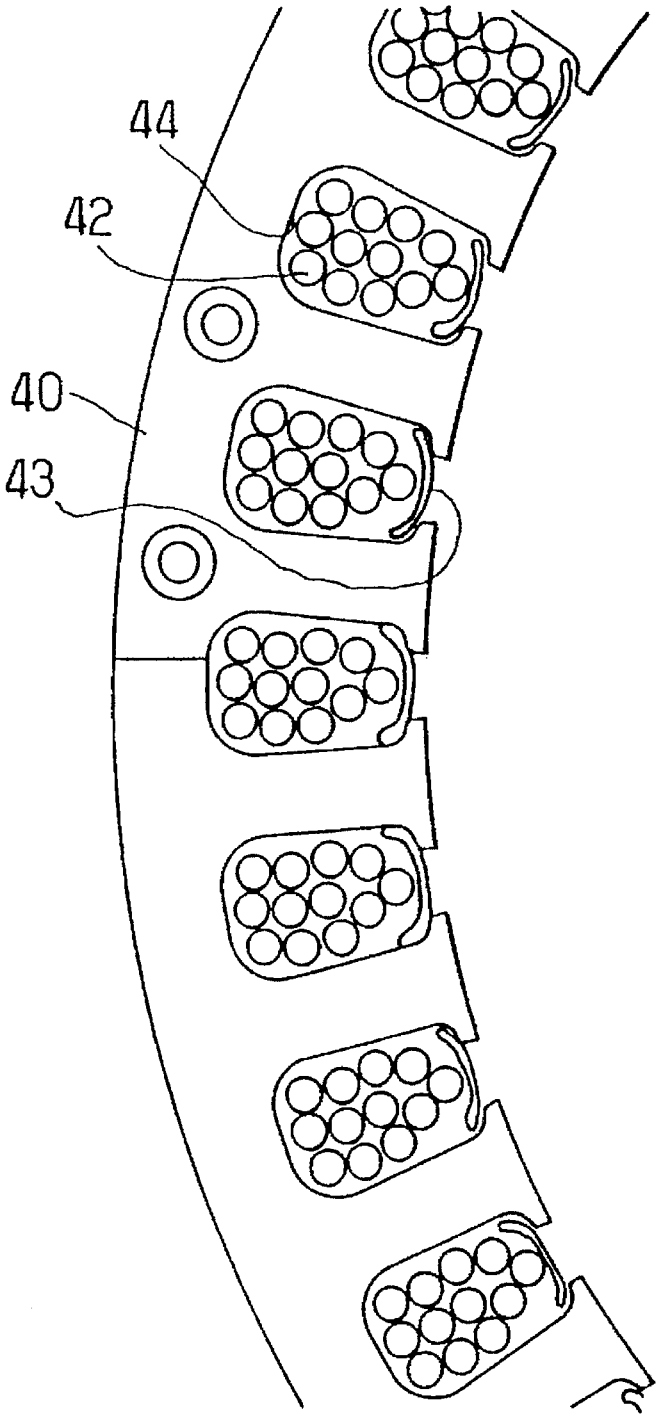
FIG. 39 is an enlarged view of a part of the core in Example 13.

The condition inside the slot sections 44 after the coils were completed is shown in FIG. 39.

After the coils were completed, a wedge 43 was placed inside to prevent the coils 42 from slipping out.

Then, to check for an earth (tearing of the insulation) in the coils 42 and body of the stator core 40, 600 V AC was applied thereto, and the treated product withstood mechanical coil processing, having a withstand voltage of 600 V (AC) or greater.

Conventional non-electrolytic chemical treatment was then carried out instead of the chemical treatment in Example 13, followed by Cation electrodeposite painting as in Example 13, and the insulation layer thereof tore under the above mentioned mechanical coil processing, and could not support 600 V AC. Thus, it may be said that the inorganic insulation film according to the present invention is effective for alternator insulation treatment.

Figure 40:
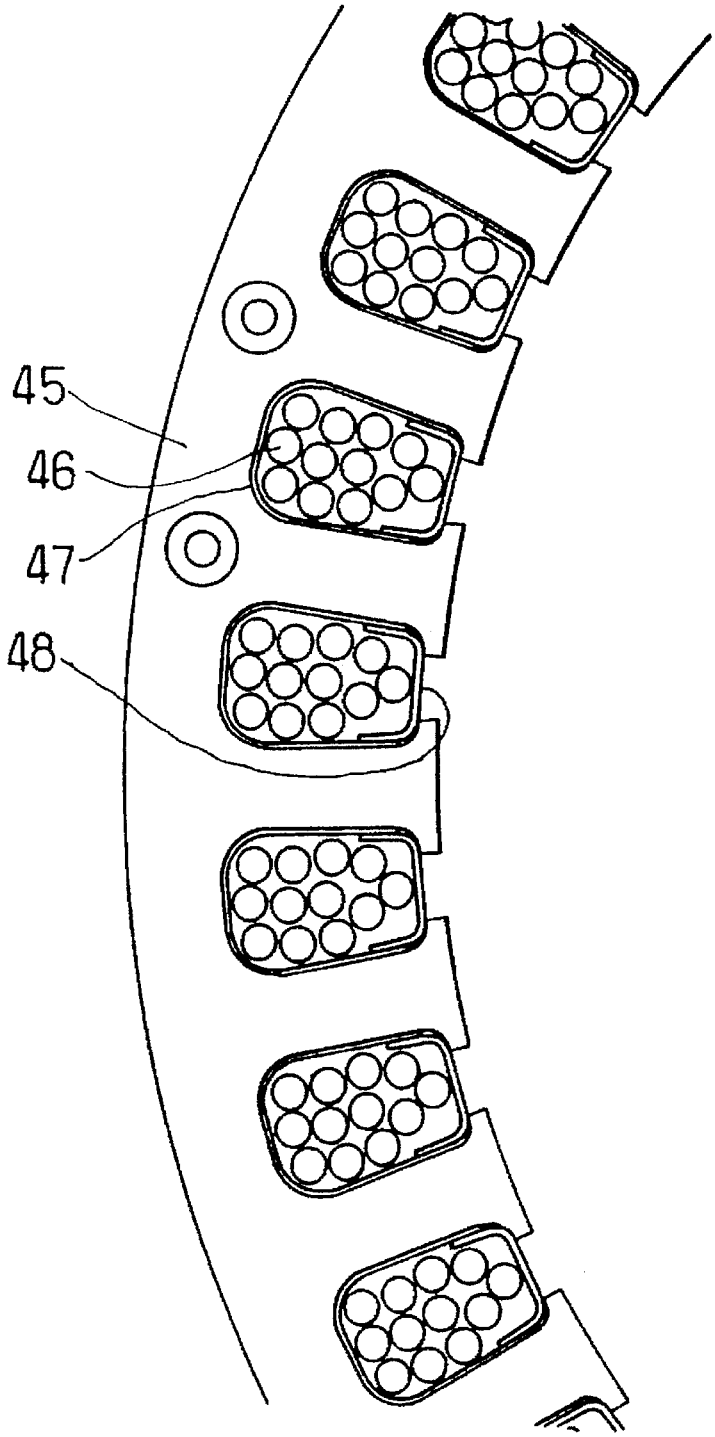
FIG. 40 is an enlarged view of a part of a core according to the prior art.

Furthermore, for insulation treatment of this type of conventional alternator stator core 45, a paper insulator (organic insulation paper) 47 is used between the core 45 and the coils 46, as shown in FIG. 40, and then a wedge 48 is used to seal in the coils 46. However, the film thickness of the paper insulator is 200 μm, and this portion complicates the miniaturization of the core 40. Also, with paper insulators of 200 μm or less problems arise such as tearing during the mechanical coil processing.

Therefore, by the insulation treatment in Example 13, a film may be produced with a thickness of 50–70 μm, which is thinner than according to the method of the prior art, and with an adequate insulating effect.

Thus, by employing the phosphate chemical treatment method according to the present invention to the necessary sections of an insulation, as in the core 40, it is possible to eliminate the conventional insulating materials, and this method may be applied in a variety of ways.

Finally, Table 4 lists the electrochemical differences between the electrolytic chemical treatment method in the transparent treatment bath according to the present invention and the non-electrolytic chemical treatment method according to the prior art.

TABLE 4

| | Electrolytic treatment method | | Non-electrolytic treatment method |
|---|---|---|---|
| Electrochemical energy level in treatment bath | High<br>Supply of electrons from external power source | | Low<br>Supply of electrons only from dissolution of iron |
| Iron ion state | $Fe^{3+}$ present<br>$Fe^{2+}$ present | $Fe^{3+}$ absent<br>$Fe^{2+}$ present | $Fe^{3+}$ absent<br>$Fe^{2+}$ present |
| Oxidation-reduction potential of treatment bath (AgCl electrode potential) | 560 mV or greater | 560 mV or less | 560 mV or less |

As shown in Table 4 above, the electrolytic method (clear bath) was performed with an ORP of either 560 mV or greater, or 560 mV or less.

Since at an ORP of 560 mV or greater the treatment bath contains paramagnetic ion ($Fe^{3+}$), the following points must be considered regarding the circulation cycle, in order to maintain the treatment bath at an ORP of 560 mV or greater.

That is, the magnetic field must not be allowed to influence the circulation cycle. If the magnetic field acts on the treatment bath, then it will affect the paramagnetic components ($Fe^{3+}$), and as a result the $Fe^{3+}$ will dissolve in the treatment bath(s) and disappear, leaving no $Fe^{3+}$ in the treatment bath(s). Consequently, the ORP will by necessity fall below 560 mV.

A bath with an ORP of 560 mV or greater contains $Fe^{3+}$, and therefore its electrolytic tendency is stronger compared with a conventional non-electrolytic bath (which contains no $Fe^{3+}$). Also, its properties are thought to render it easy to form a chemical film onto metal materials having a passivation film on the surface of aluminum, stainless steel, and the like. In other words, since its electrolytic tendency is stronger, the electrolytic treatment is thought to be capable of acting on a passivation film on the surface and dissolving it to form a film. Furthermore, a film which is formed from a bath at 560 mV or less contains no $Fe^{3+}$, and thus it has the same properties as a conventional non-electrolytic chemical film. Nevertheless, by the method according to the present invention it is possible to control the film thickness thereof.

An additional explanation is provided below of the main points relating to the electrolytic treatment constituting the present invention. The main points regarding the electrolysis according to the present invention are:

(1) The electrolytic reaction system is separated into a "main electrolysis system" and a "secondary electrolysis system", to control the iron component contributing to the formation of the coating; and (2) Current scanning electrolysis is performed; and the reasons therefor are described again below.

Reasons for (1)

The iron ion contributing to the electrolysis reaction must be controlled, and the "secondary electrolysis system" performs this role. Particularly, during the cathodizing, since the material to be treated is used as the cathode, the manner in which the iron ion is dissolved and deposited onto the surface of the material to be treated is important. Also, if the iron is used as the electrode material, the concrete method of applying the current and voltage to the iron electrode is important. The secondary electrolysis system mainly controls the dissolution and deposition of the iron ion, and combined with the main electrolysis system it is effective for the formation of a favorable coating.

Reasons for (2)

This is a necessary condition for the production of a thick coating.

Figure 41:
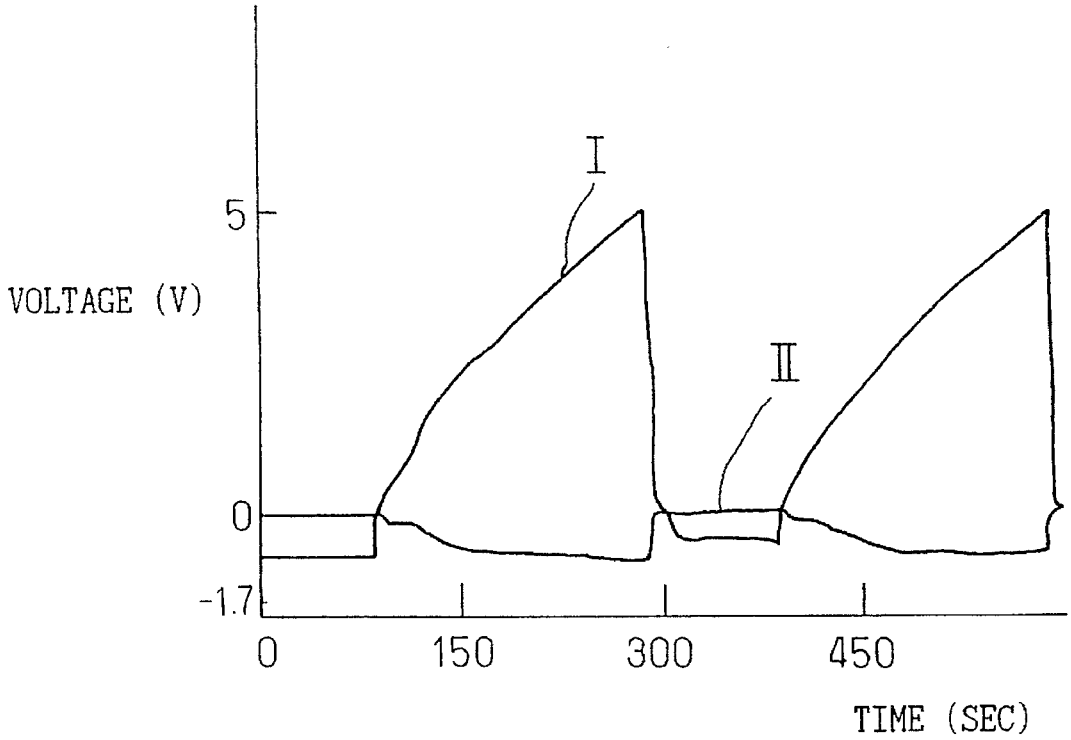
FIG. 41 is a characteristic graph showing the current and voltage characteristics for Example 14.

An embodiment of the current scanning electrolysis is shown in FIG. 41 as Example 14.

FIG. 41 relates to the current application in FIG. 5 (*c*) in the apparatus shown in FIG. 2, and shows the voltage change I in the "main electrolysis system" between the material to be treated 7 and the electrode 6 (with positive being the direction from the electrode 6 to the material to be treated 7) and the voltage change II in the "secondary electrolysis system" between the material to be treated 7 and the electrodes 10, 11 (with positive being the direction from the material to be treated 7 to the electrodes 10, 11).

Here, in FIG. 41, the current applied to the main electrolysis system from an external power source as in FIG. 5 (*c*), was successively raised over a period of 300 seconds from 0 A→4.0 A/cm$^2$.

Under such conditions, as shown in FIG. 41, although during the initial 90–100 seconds of application of the current for 300 seconds the current is applied externally, the voltage change I is a negative value, and the voltage change II is approximately zero.

This indicates that the potential between the electrodes in the chemical treatment bath when no current is applied, or when only an extremely small current is applied, is:

[Material to be treated]=[opposite electrodes of secondary electrolysis system (Fe Ni)]>[opposite electrode of main electrolysis system (Zn)].

In other words, since the chemical treatment bath is itself an electrolytic bath, an electric potential difference arises between the electrodes (materials) immersed therein. Furthermore, the state of the bath reflecting the potential difference when no current is applied may be said to be the most stable state of the chemical treatment bath.

During the period in which the voltage change I produces a minus potential, no current flows between the anode (Zn) and the cathode (material to be treated) in the main electrolysis system A, despite the current being input from the external power source in FIG. 41. However, the current here may be seen as acting upon the components in the solution. Also, this action on the components in the solution is very important for the formation of a dense film. The voltage change I in FIG. 41 indicates that the current flows in the main electrolysis system by this process to form a film.

Furthermore, while the current flows for the voltage change I, the voltage of the voltage change II in FIG. 41 becomes a minus value, and this indicates that the current from the positive electrode 6 in the main electrolysis system in FIG. 2 is acting on the opposite electrodes 10, 11 in the secondary electrolysis system B in FIG. 2.

In other words, the current from the positive electrode 6 in FIG. 2 produces a minus potential as it flows through the electrodes 11, 12 via the diode D to the material to be treated in FIG. 2. Thus, the voltage changes I and II are related.

This fact shows that the electrolysis of the zinc in the main electrolysis system A is the controlling factor over the electrolysis of the iron and nickel, etc., in the secondary electrolysis system B. By repetition of the processes, a film is formed.

Thus, by carrying out current scanning electrolysis as shown in FIG. 5 (*c*) for cathodizing in the main electrolysis system of the apparatus shown in FIG. 2, it is possible to constantly restore the bath to an energy-stable state for the formation of the film from that state, while it is also possible to control the excess dissolution of the electrodes 10, 11 in the secondary electrolysis system B by controlling the electrolysis at the electrode 6 in the main electrolysis system A. As a result, a dense film may be formed onto the material being treated.

As a comparison of the electrolytic methods will be clearly seen by comparison with the constant current electrolysis in FIG. 5 (*a*).

In the method in FIG. 5 (*a*), the current immediately flows at a prescribed voltage. Also, an electrolytic reaction occurs, but it is similar to that which occurs for the forming of good conductive coatings, such as electroplatings, etc., and it is clearly different from the method in FIG. 5 (*c*). In the method in FIG. 5 (*c*), the energy state during the electrolysis constantly displays the maximum voltage of the voltage change I in FIG. 4. Thus, the solution always has a strong current applied to it. In addition, the majority of the current constantly flows through a given section of the material being treated (for example, the edge section), and consequently the adhesion at such sections is poor.

The current scanning electrolysis according to the present invention differs greatly from constant current electrolysis in that during the forming of the coating, the electrolytic coat-forming reaction of the components in the solution is constantly repeated beginning from the initial state in which the solution is not electrolyzed. This design contributes greatly to the adhesion of the coating.

Industrial Applicability

As mentioned above, the phosphate chemical treatment method according to the present invention may be used as a method of pretreatment prior to the cold forging of a metal material such as a stator.

I claim:

1. A method of forming a phosphate chemical film on an electroconductive metal comprising the steps of:

(i) contacting an electroconductive metal with a phosphate chemical treatment solution comprising a phosphate ion, a nitrogen-containing oxoacid ion and a chemical film forming metal ion;

(ii) subjecting said electroconductive metal to an electrolytic treatment in said phosphate chemical treatment solution wherein an electric current is caused to pass through said phosphate chemical treatment solution by connecting said electroconductive metal and said phosphate chemical treatment solution to an electric power source;

(iii) controlling energy sources affecting said phosphate chemical treatment solution, wherein said controlling step includes maintaining said phosphate chemical treatment solution at a temperature not greater than about 40° C. and maintaining in said phosphate chemical treatment a concentration of said phosphate ion of 4 to 150 g/l, a concentration of said chemical film forming metal ion of 1.5 to 40 g/l, a concentration of said nitrogen-containing oxoacid ion of 3 to 150 g/l, a pH of 2 to 4, a redox potential of 460 to 860 mV as a standard hydrogen electrode potential, and an electric current with a current density of 0.01 to 4 A/dm$^2$, said current density being measured with respect to a surface area of said electroconductive metal, such that said phosphate chemical treatment solution is substantially free of energy-destabilizing sludge; and (iv) circulating and filtering said phosphate chemical treatment solution so as to remove said energy-destabilizing sludge, if any, therefrom.

2. The method of forming a phosphate chemical film on an electroconductive metal as set forth in claim 1, wherein said subjecting step includes the step of anodizing said electroconductive metal.

3. The method of forming a phosphate chemical film on an electroconductive metal as set forth in claim 1, wherein said subjecting step includes the step of cathodizing said electroconductive metal.

4. The method of forming a phosphate chemical film on an electroconductive metal as set forth in claim 1, wherein said subjecting step includes the step of anodizing said electroconductive metal before cathodizing said electroconductive metal.

5. The method of forming a phosphate chemical film on an electroconductive metal as set forth in claim 1, wherein said subjecting step includes the step of maintaining an oxidation-reduction potential of said phosphate chemical treatment solution in the range of from about 250 mV to about 650 mV, as determined by the silver-silver chloride electrode potential.

6. The method of forming a phosphate chemical film on an electroconductive metal as set forth in claim 1, wherein said subjecting step includes the step of maintaining said phosphate chemical treatment solution at a temperature of about 40° C.

7. The method of forming a phosphate chemical film on an electroconductive metal as set forth in claim 1, wherein said controlling step includes the step of maintaining said phosphate chemical treatment solution at a temperature in the range of from about 20° C. to about 35° C.

8. The method of forming a phosphate chemical film on an electroconductive metal as set forth in claim 1, wherein said controlling step includes the step of controlling phase transition phenomena in said phosphate chemical treatment solution such that solid formation in said phosphate chemical treatment solution is substantially limited to a film-forming reaction on said electroconductive metal.

9. The method of forming a phosphate chemical film on an electroconductive metal as set forth in claim 1, wherein said electroconductive metal is comprised of at least one member selected from the group consisting of copper, copper alloy, aluminum, aluminum alloy, stainless steel and and magnetic materials.

10. The method of forming a phosphate chemical film on an electroconductive metal as set forth in claim 1, wherein said electrical current produces a voltage of 0 to 10 V at a reaction surface of said electroconductive metal.

11. A method of forming a phosphate chemical film on an electroconductive metal comprising the steps of:

(i) contacting an electroconductive metal which includes at least one member selected from the group consisting of copper, copper alloy, aluminum, aluminum alloy, steel and steel alloy with a phosphate chemical treatment solution comprising a phosphate ion, a nitrogen-containing oxoacid ion, a chemical film forming metal ion and an oxidizing agent to induce a film forming reaction;

(ii) subjecting said electroconductive metal to an electrolytic treatment in said phosphate chemical treatment solution wherein an electric current is caused to pass through said phosphate chemical treatment solution by connecting said electroconductive metal and said phosphate chemical treatment solution to an electric power source;

(iii) stabilizing the thermodynamic energy state of said phosphate chemical treatment solution by controlling energy sources affecting said phosphate chemical solution, wherein said stabilizing step includes the step of maintaining said phosphate chemical treatment solution at a temperature not greater than about 40° C. and maintaining a concentration of said phosphate ion of 4 to 150 g/l, a concentration of said chemical film forming metal ion of 1.5 to 40 g/l, a concentration of said nitrogen-containing oxoacid ion of 3 to 150 g/l, a pH of 2 to 4, a redox potential of 460 to 860 mV as a standard hydrogen electrode potential, and an electric current of 0.01 to 4 A/dm$^2$, said current density being measured with respect to a surface area of said electroconductive metal, such the resulting thermodynamic energy state in said phosphate chemical treatment solution substantially prevents the formation of energy-destabilizing sludge; and (iv) circulating and filtering said phosphate chemical treatment solution so as to remove said energy-destabilizing sludge, if any, therefrom.

12. The method of forming a phosphate chemical film on an electroconductive metal as set forth in claim 11, wherein said subjecting step includes the step of anodizing said electroconductive metal.

13. The method of forming a phosphate chemical film on an electroconductive metal as set forth in claim 11, wherein said subjecting step includes the step of cathodizing said electroconductive metal.

14. The method of forming a phosphate chemical film on an electroconductive metal as set forth in claim 11, wherein said subjecting step includes the step of anodizing said electroconductive metal before cathodizing said electroconductive metal.

15. The method of forming a phosphate chemical film on an electroconductive metal as set forth in claim 11, wherein said subjecting step includes the steps of anodizing a film forming material and cathodizing said electroconductive metal, wherein said anodizing step and said cathodizing step occur in the phosphate chemical treatment solution.

16. The method of forming a phosphate chemical film on an electroconductive metal as set forth in claim 11, wherein said stabilizing step includes the step of maintaining an oxidation-reduction potential of said phosphate chemical treatment solution in the range of from about 250 mV to about 650 mV, as determined by the silver-silver chloride electrode potential.

17. The method of forming a phosphate chemical film on an electroconductive metal as set forth in claim 11, wherein said stabilizing step includes the step of maintaining said phosphate chemical treatment solution at a temperature of about 40° C.

18. The method of forming a phosphate chemical film on an electroconductive metal as set forth in claim 11, wherein said stabilizing step includes the step of maintaining said phosphate chemical treatment solution at a temperature in the range of from about 20° C. to about 35° C.

19. The method of forming a phosphate chemical film on an electroconductive metal as set forth in claim 11, wherein said stabilizing step includes the step of controlling phase transition phenomena in said phosphate chemical treatment solution such that solid formation in said phosphate chemical treatment solution is substantially limited to said film-forming reaction on said electroconductive metal.

20. The method of forming a phosphate chemical film on an electroconductive metal as set forth in claim 11, wherein said electrical current produces a voltage of 0 to 10 V at a reaction surface of said electroconductive metal.

21. A method of forming a phosphate chemical film on an electroconductive metal comprising the steps of:

(i) contacting an electroconductive metal with a phosphate chemical treatment solution comprising a phosphate ion, a nitrogen-containing oxoacid ion and a chemical film forming metal ion;

(ii) subjecting said electroconductive metal to an electrolytic treatment in said phosphate chemical treatment solution wherein an electric current is caused to pass through said phosphate chemical treatment solution by connecting said electroconductive metal and said phosphate chemical treatment solution to an electric power source;

(iii) controlling energy sources affecting said phosphate chemical treatment solution, wherein said controlling step includes maintaining said phosphate chemical treatment solution at a temperature not greater than about 40° C. and maintaining in said phosphate chemical treatment solution a concentration of said phosphate ion of 4 to 150 g/l, a concentration of said chemical film forming metal ion of 1.5 to 40 g/l, a concentration of said nitrogen-containing oxoacid ion of 3 to 150 g/l, a pH of 2 to 4, a redox potential of 460 to 860 mV as a standard hydrogen electrode potential, and an electric current of 0.01 to 4 A/dm$^2$, said current density being measured with respect to a surface area of said electroconductive metal, such that said phosphate chemical treatment solution is substantially free of energy-destabilizing sludge; and (iv) circulating a portion of said phosphate chemical treatment solution through a circulating path, and filtering said portion with a filter comprising an inorganic material, wherein a thermodynamic energy balance in said phosphate chemical treatment solution is thereby controlled and stabilized to prevent the formation of solids from the chemical components contained therein.

* * * * *